US010499772B2

(12) United States Patent
Ahmes et al.

(10) Patent No.: US 10,499,772 B2
(45) **Date of Patent: *Dec. 10, 2019**

(54) BATHTUB FITTING STANDARD EXTERNAL SPACE WHILE AFFORDING SAFE EGRESS AND LARGER FLOOR AREA WITH ENCLOSED VOLUME

(71) Applicant: BRAK TUB CORP, Brightwaters, NY (US)

(72) Inventors: Bruce Ahmes, St. James, NY (US); Ryan Ahmes, Brightwaters, NY (US); Kenneth Piccininni, Hauppauge, NY (US)

(73) Assignee: BRAK TUB CORP., Brightwaters, NY (US)

( * ) Notice: Subject to any disclaimer, the term of this patent is extended or adjusted under 35 U.S.C. 154(b) by 6 days.

This patent is subject to a terminal disclaimer.

(21) Appl. No.: 15/940,564

(22) Filed: Mar. 29, 2018

(65) Prior Publication Data

US 2018/0279839 A1 Oct. 4, 2018

Related U.S. Application Data

(63) Continuation of application No. 15/729,313, filed on Oct. 10, 2017, now Pat. No. 10,292,537, which is a (Continued)

(30) Foreign Application Priority Data

Aug. 3, 2015 (CN) ..... 2015 3 0286765
Sep. 18, 2015 (CA) ..... 164498
Jun. 8, 2016 (AU) ..... 2016100845

(51) Int. Cl.
*A47K 3/04* (2006.01)
*A47K 3/00* (2006.01)
*A47K 3/02* (2006.01)

(52) U.S. Cl.
CPC ..... *A47K 3/04* (2013.01); *A47K 3/001* (2013.01); *A47K 3/02* (2013.01)

(58) Field of Classification Search
CPC ..... A47K 3/04; A47K 3/001; A47K 3/02
(Continued)

(56) References Cited

U.S. PATENT DOCUMENTS 2,431,475 A * 11/1947 Gruen ..... A47K 3/008 4/595
2,564,190 A * 8/1951 Danielson ..... A47K 3/02 4/577.1

(Continued)

*Primary Examiner* — Tuan N Nguyen
(74) *Attorney, Agent, or Firm* — Alfred M. Walker

(57) ABSTRACT

A method of making a safe egress bathtub providing safe egress by reducing slide forces extended on a user's feet upon a slippery bathtub floor, wherein the formed bathtub has a limited rectangular footprint, and an optimized floor space is formed with a substantially planar base with a length and width that define the limited rectangular footprint and a front wall, a back wall, a first side wall and a second side wall integral with and extending substantially vertically upwards from the substantially planar base. Each of the front, back, first side wall and second side wall have minimal wall thicknesses to define the optimized floor space and the front wall has a substantially planar inwardly, cantilevered upper apron deck in a substantially parallel relation to the substantially planar base.

5 Claims, 18 Drawing Sheets

Related U.S. Application Data continuation-in-part of application No. 15/232,709, filed on Aug. 9, 2016, now Pat. No. 9,801,504, which is a continuation-in-part of application No. 15/201,448, filed on Jul. 2, 2016, now Pat. No. 9,877,615, which is a continuation-in-part of application No. 14/724,380, filed on May 28, 2015, now Pat. No. 9,648,989, which is a continuation-in-part of application No. 14/718,662, filed on May 21, 2015, now Pat. No. 9,648,987, which is a continuation-in-part of application No. 14/688,413, filed on Apr. 16, 2015, now Pat. No. 9,848,739, which is a continuation-in-part of application No. 29/521,732, filed on Mar. 26, 2015, now Pat. No. Des. 737,416.

(60) Provisional application No. 62/111,453, filed on Feb. 3, 2015.

(58) Field of Classification Search
USPC ..... 4/584
See application file for complete search history.

(56) References Cited

U.S. PATENT DOCUMENTS 5,678,256 A * 10/1997 Lea ..... A47K 3/001 4/496
9,848,739 B2 * 12/2017 Ahmes ..... A47K 3/001

* cited by examiner

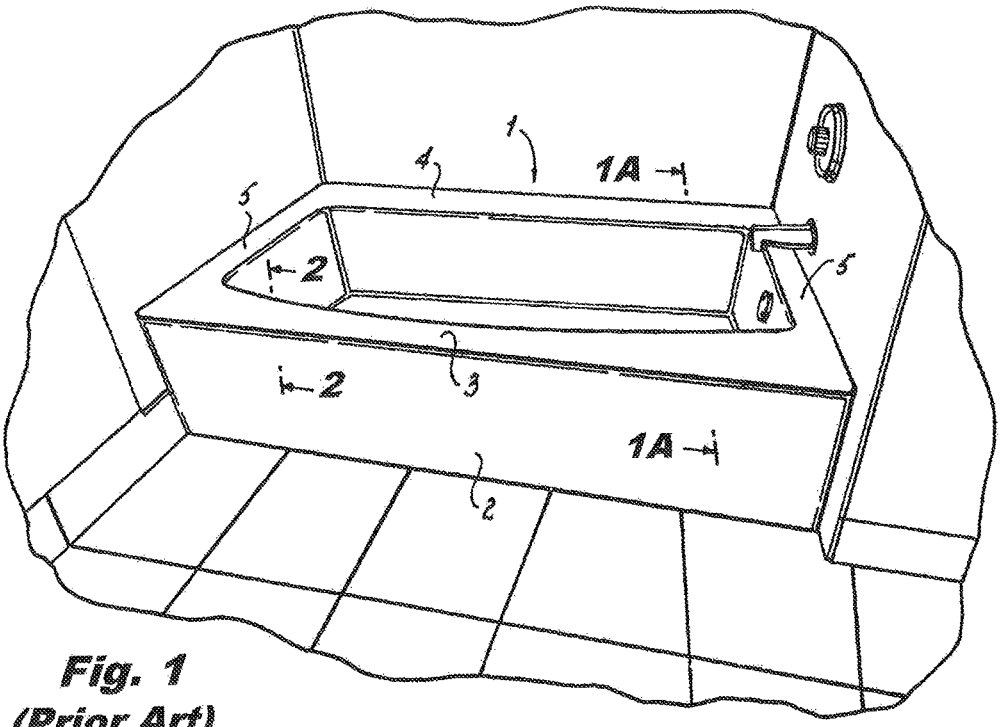
Fig. 1
(Prior Art)
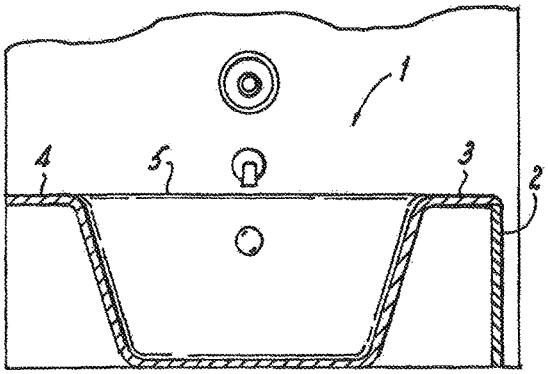
Fig. 1A
(Prior Art)
Fig. 2
(Prior Art)
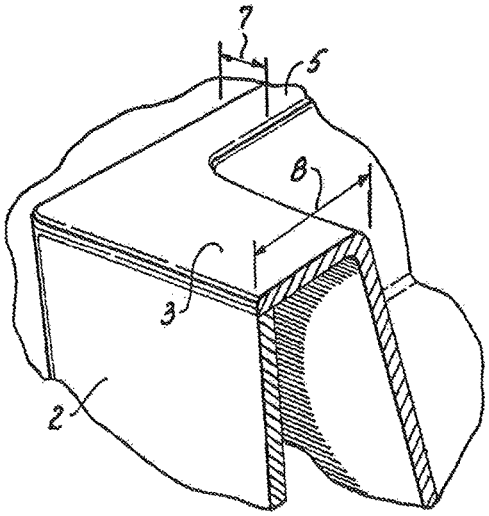

Fig. 15
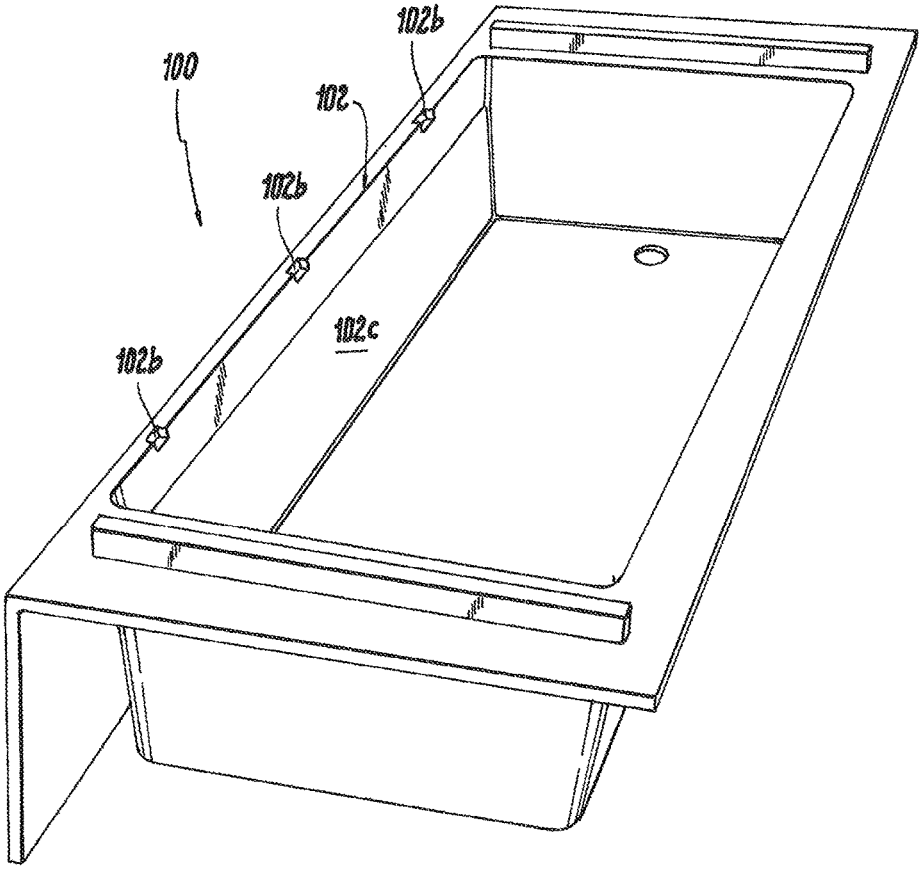
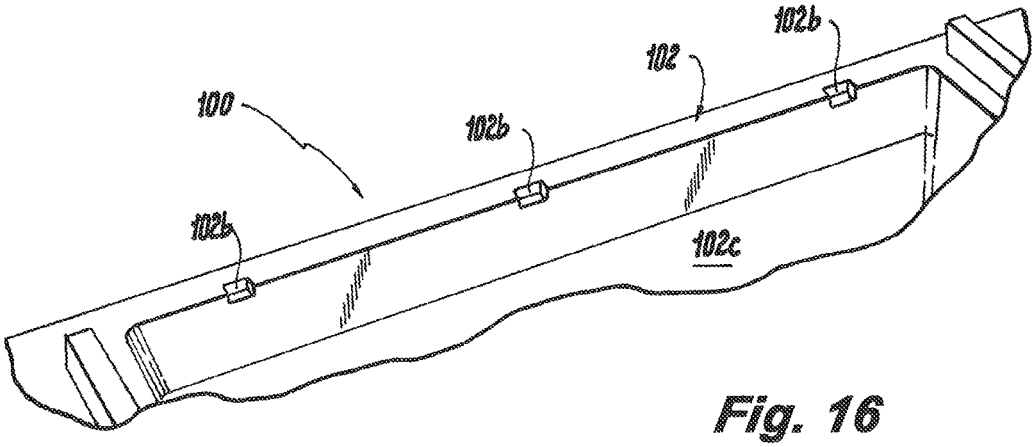
Fig. 16

Fig. 18
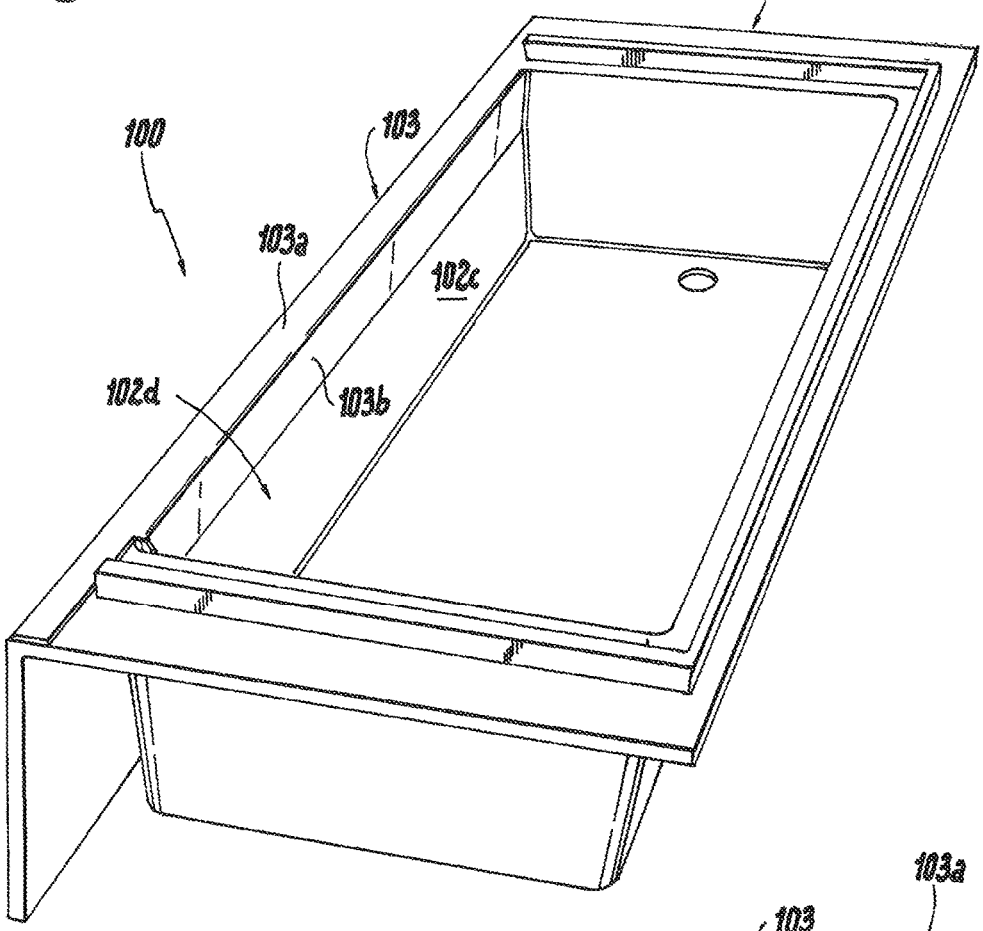
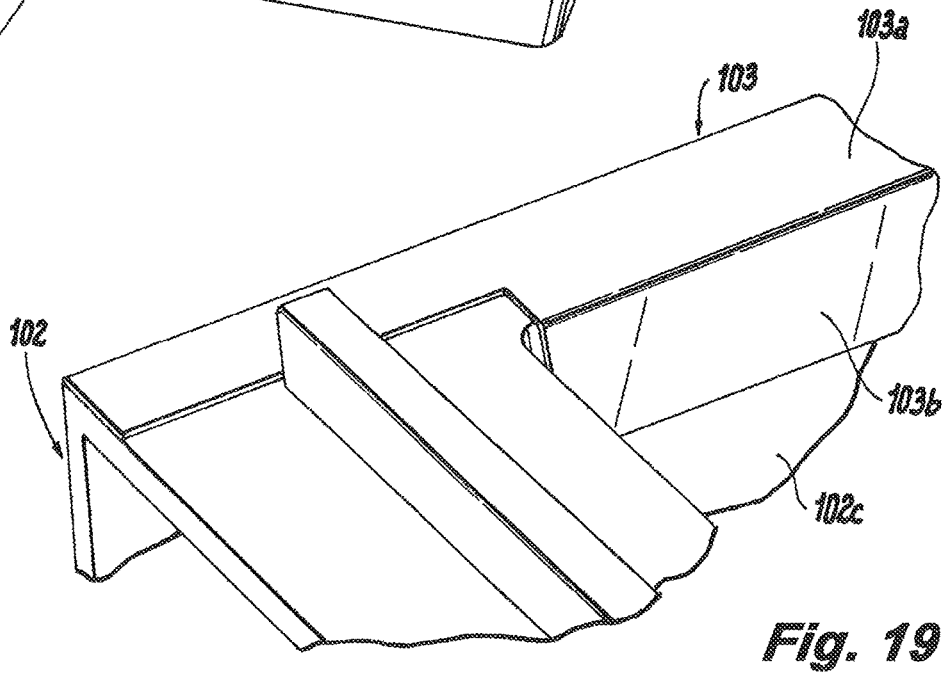
Fig. 19

BATHTUB FITTING STANDARD EXTERNAL SPACE WHILE AFFORDING SAFE EGRESS AND LARGER FLOOR AREA WITH ENCLOSED VOLUME

RELATED APPLICATIONS

This application is a continuation of application Ser. No. 15/729,313 filed Oct. 10, 2017 (the '313 application), which is a continuation-in-part of application Ser. No. 15/232,709 filed Aug. 9, 2016 ("the '709 application"), now U.S. Pat. No. 9,801,504 B2 dated Oct. 31, 2017, which '709 application is a continuation-in-part of application Ser. No. 15/201,448 filed Jul. 2, 2016 ("the '448 application"), now U.S. Pat. No. 9,877,615 B2 dated Jan. 30, 2018. The '448 application is a continuation in part of application Ser. No. 14/724,380 filed May 28, 2015 ("the '380 application"), now U.S. Pat. No. 9,648,989 B2 dated May 16, 2017. The '380 application is a continuation-in-part of application Ser. No. 14/718,662, filed May 21, 2015 ("the '662 application") now U.S. Pat. No. 9,648,987 B2 dated May 16, 2017, which '662 application is a continuation-in-part of application Ser. No. 14/688,413 filed Apr. 16, 2015, ("the '413 application"), now U.S. Pat. No. 9,848,739 B2 dated Dec. 26, 2017. The '413 application is a continuation-in-part of application Ser. No. 29/521,732, filed Mar. 26, 2015, now U.S. Design Pat. No. D737,416 S, dated Aug. 25, 2015. The '313, '709, '448, '380, '662, '413 and '732 applications are incorporated by reference herein, and Applicants claim priority in part under 35 USC § 120 therefrom. This application also claims the benefit of provisional patent application No. 62/111,453 filed Feb. 3, 2015 ("the '453 application") under 35 USC § 119(e). The '453 application is incorporated by reference herein.

FIELD OF THE INVENTION

The present invention relates to providing safe egress from wet bathtub floors and to maximizing internal bathtub/shower stall space within predetermined confines of typical residential bathroom space dimensions.

BACKGROUND OF THE INVENTION

Safety studies indicate over 234,000 bathroom injuries each year, of which 81 percent occurred because of falls in the bathroom. See Bakalar, "Watch Your Step While Washing Up", New York Times, Aug. 15, 2011, citing CDC Centers for Disease Control and Prevention, "Nonfatal Bathroom Injuries Among Persons Aged >15 Years, United States, 2008", Morbidity and Mortality Weekly Report (MMWR), 60 (22); 729-733, Jun. 10, 2011. Of these injuries, more than one third happen while bathing or showing. The Center for Disease Controls (CDC) estimates that 9.8 percent of all bathroom injuries specifically occur when getting out of a bathtub, which equals at least 22,932 injuries.

Applicants believe that injuries while getting out of a bathtub occur because of the wide straddling of the bather's legs when exiting a bathtub. The horizontal component force Fs that arises from this prior art arrangement is 0.306 W or almost 31% of the weight of the person. This horizontal component must be resisted by the frictional force between the ball of the anchor foot and the tub (or a tub mat). Several items affect the local coefficient of friction between foot and tub, or foot and mat and mat to tub. Water, and especially soapy water, is a good lubricant and dramatically reduces the coefficient of friction. If the widely straddled anchor foot slips, the bather's weight is subject to horizontal sideways force and prone to dangerous falls while attempting to exit the bathtub.

The American Occupational Therapy Association (AOTA), provides recommendations that stair treads and other household items have contrasting colors, to enhance the depth perception of persons with or without impaired vision who are walking in a home environment. AOTA notes in "*Maintaining Quality of Life With Low Vision*", in "Tips for Living", 2003, that the visually impaired person's environment should be altered to help the person identify everyday items so that they "stand out" i.e. "provide a contrast" by marking them with bright colors so that they can be seen.

In "*Low Vision FAQ*" of AOTA, 2016, it is noted that visibility of objects can be "improved by increasing contrast between the foreground and the background. Optimal colors are black and white, but it is also useful to use opposite colors on the color wheel. Examples of commercially available objects include high-contrast tape for edges of stairs or cabinets, signature or writing guides, measuring cups and so forth."

The organization known as Rebuilding Together of Greater Milwaukee, in "*Safe at Home, Suggestions for Homeowner*" notes to "Apply color contrast or texture change at top and bottom stair edges".

In Dhital et al, "*Vision loss and falls: a review*" in Eye, (2010) 24, 1437-1446, 7 May 2010, it is noted that vision loss occurs in the elderly who are most vulnerable to household falls and that lack of depth perception is a cause of falls. Dhital et al also notes that the Washington D.C. Metro underground railway has added visual contrast to help delineate surfaces and drop-offs on Metro subway trains and stations, (citing Freeman P B, "*Steady as she goes*", Editorial perspective, J. Optometry 2009, 80:161-162).

In addition to the aforementioned safety issues, when viewed in crossection from an end, conventional prior art bathtubs have limited interior bathing space by virtue of the fact that the upper apron deck provided for sliding glass doors is usually three or more inches in top width, which narrows considerably the interior bathing or showering space or volume within the conventional bathtub. Additionally, for symmetry purposes, a similar opposite wall abutting top edge is also typically three or more inches in top width, thereby further limiting the space or volume within the bathtub. While bathtubs are generally four to six feet in length, typical residential bathrooms generally have a limited rectangular footprint area of 60 inches by 30 or 32 inches within which to locate a bathtub and shower installation. So losing 1, 2, 3 or 4 inches in width results in a significant reduction in the overall internal space or volume within a typical bathtub.

Among known prior art patents includes U.S. Pat. No. 2,431,475 of Gruen, which discloses the elimination of a front bathtub apron wall and the creation of an apron effect, by providing a front wall having an upper edge wall fanning outward, both inside the tub and outwards from the front of the tub, to prevent water from splashing out of the bathtub.

US Patent Application 2011/0167728 of Alelov discloses an "Expandable Side Enclosure for Bathtubs/Showers", to provide a solution to prevent arm movement restrictions caused to bathers in bathtubs and/or showers due to the lack of free body and limb movement in baths with standard enclosures. While Alelov provides outwardly extended bay-type windows in the sliding glass doors, which are at standing arm height, to provide more movement of the arms during a shower. However, Alelov does not increase the internal volume of the bathtub itself.

U.S. Pat. No. 1,811,896 of Ross discloses a circular topped truncated conical water basin/bowl/tub with an inwardly inverted anti-splash lip/flange. However, Ross cannot be installed in a typical rectangular bathtub footprint in a residential bathroom.

U.S. Design Pat. D619,685 of Hoernig discloses a shower and tub with a "flip up out of the way" apron deck, to expand the interior space of the bathtub. However, Hoernig requires moving parts and hinges, which are complicated and detrimental in a high humidity bathtub environment.

U.S. Design Pat. Des. 335,701 of Zaccui discloses a bathtub which increases interior space by having bulging outwardly extending side walls. However, the bulging sides of Zaccui '701 prevents its installation within a standard bathtub area.

U.S. Pat. No. 7,490,371 B2 of Torres describes a shower receptor base pan formed from a one piece mold, but where the sheet molding compound (SMC) is placed in a two piece mold, and formed and cured.

U.S. Pat. No. 5,303,519 of Mustee describes using a two piece mold to form bathroom shower walls with undercuts to form side wall mounting groove recesses.

These known prior art devices do not maximize internal bathtub/shower stall space within the predetermined confines of typical residential bathroom space dimensions. The use of a small depth apron deck, such as a thin front bathtub wall with straight edges, or optionally with an inwardly extending only cantilevered top apron edge in the present invention for an expanded space bathtub, where the rear wall has no apron edge, would be discouraged, if not clearly taught away from the prior art patents.

Therefore, the use of a bathtub with both a narrow apron deck, such as an inwardly extending apron deck of about 2-3 inches in depth, on a front wall having a top width of about one inch to about two and one half inches in width, together with an expanded footprint and volume for the bathtub, as in Applicants' present invention, in conjunction with the spatial confines of a rectangular bathtub installation area of a residential bathroom, is not only not suggested, but would be discouraged or taught away by the designs known from the conventional arts.

OBJECTS OF THE INVENTION

An object of the present invention is to provide a bathtub which provides safe egress for the bather.

It is also an object of the present invention to minimize falls from bathtubs by providing a structural front wall which minimizes wide straddling of the bathtub front wall by a bather exiting from the wet bathtub.

Another object is to provide a bathtub that fits within standard tub dimensions but has a larger internal floor area and larger volume within. Most bathtubs are used for taking showers but are dimensioned for tub use. The inventive bathtub better accommodates its shower use while still affording the choice of use as a soaking tub. The larger interior floor area of the bathtub simulates the feel of a larger shower by being less confining.

In a preferred embodiment the apron deck is cantilevered from the front vertical surface of the front wall inward and then rejoins the thin front wall at near the top of the rear vertical surface of the front wall, thereby realizing a tub that does not suffer a reduction in the interior floor space by the front deck width. The floor area covered by a projection of the front deck is usable space for visual appearance, as well as actual space for feet while standing and taking a shower. In this preferred embodiment, the inwardly cantilevered apron deck has an undercut, which preferably requires the use of a secondary mold of a two piece mold for forming.

In a non-preferred optional embodiment, the front deck width still is maintained to accommodate sliding door tracks thereon, however, to support sliding glass doors. The side decks and back deck are just the thickness of the tub material. In this alternate embodiment, the front deck is maintained with a width of up to a maximum of 3.5 inches, or preferably between one inch and two and one half inches, according to a width required to accommodate siding door tracks. In one embodiment the apron deck is on top of a wall having the same width, except for an increase of one quarter inch on the bottom.

In a further alternate embodiment, it is also an object of the present invention to provide the bathtub with contrasting colors on selected surfaces of the bathtub, to enhance depth perception of a bather entering or exiting a bathtub with at least a wet floor, or a volume of water therein.

SUMMARY OF THE INVENTION

The substantially vertical walls and thinness of the front wall of the bathtub of the present invention minimize injuries from falls by providing safe egress from the bathtub, by virtue of the fact that the user has a very small straddling angle measured by the angle of the anchor foot planted in the bathtub, as compared to an imaginary vertical line, when lifting the leading foot over the edge of the bathtub.

As a result, in a preferred embodiment with a cantilevered front apron deck, only a small percentage, such as ten percent, of the bather's weight, is subject to slippery horizontal sliding forces. In another embodiment with an apron deck on top of a front wall with straight surfaces, another small percentage, such as fourteen percent, of the bather's weight is subject to slippery, horizontal sliding forces. This compares to a much larger percentage of weight, such as thirty percent, of the weight of a bather straddling the front wall of the bathtub when the anchor foot planted in the bathtub is far away from the front wall, resulting in a much larger straddling angle, causing substantial horizontal sliding forces of the bather's feet on the slippery bathtub floor, and/or slippery floor outside the bathtub.

The safety egress bathtub encompasses a method of providing and using a safe egress bathtub including the steps of:

a) providing the bathtub with substantially vertical back and front walls, first and second end walls, and a bottom wall, all of these walls being of rigid material, wherein the entry and egress of a bather user is accomplished by stepping over the front wall;

b) providing the front wall with a thin or cantilevered top horizontal apron deck extending from an outer surface of the front wall toward the back wall, wherein the top horizontal apron deck has sufficient width to support sliding shower wall tracks thereon;

c) the bottom floor wall extends to a rear, vertical surface of the front wall with the top apron deck adjacent the rear, vertical surface of the front wall;

d) the user places a first leg on the bottom wall of the bathtub adjacent the vertical front wall of the bathtub, the foot of the leg being generally pointed toward the front wall; and e) the user places a second leg over the front wall for stepping out of the bathtub, wherein the first leg makes with the vertical front wall an angle sufficiently small so as to reduce a horizontal component of force on the foot of the user's first leg, for reducing the incidence of slippage on a wet surface of the bathtub bottom floor.

Additionally, the bathtub of the present invention has with a limited rectangular footprint and an optimized floor space, including:

a substantially planar base with a length and width that define the limited rectangular footprint;

a front wall, a back wall, a first side wall and a second side wall integral with and extending substantially vertically upwards from the substantially planar base;

wherein each of the front, back, first side wall and second side wall have minimal wall thicknesses to define the optimized floor space, and wherein the front wall has a substantially planar cantilevered upper apron deck that extends inwardly from an outer substantially vertical front wall surface for a fixed amount to an inner substantially vertical rear wall surface in a substantially parallel relation to the substantially planar base.

The bathtub's front wall is arranged in opposing relation to the back wall and the first side wall is arranged in opposing relation to the second side wall such that all of the walls are integrally joined to define the inner bathtub volume therebetween.

The bathtub's minimal wall thickness is a minimum thickness to which the walls can be manufactured and maintain structural integrity, wherein the minimal thickness to which the wall can be manufactured is dependent on a material composition of the walls.

The bathtub's substantially planar upper apron deck extends inwardly between and integrally connected to upper portions of the first side wall and the second side wall, in a substantially parallel relation to substantially planar base.

While dimensions may vary, preferably the limited rectangular footprint of the base of the bathtub is approximately 1419 square inches.

The bathtub has a distance between an inner surface of the front and back walls and a distance between an inner surface of the first and second side walls, measured at an upper surface of the substantially planar base and a lower inner surface of the substantially planar upper apron deck, respectively, and a minimal distance between the upper surface of the substantially planar base and the substantially planar upper apron deck, define an inner air volume of the bathtub.

While dimensions may vary, preferably the interior air volume is approximately 20,845 cubic inches.

Preferably the bathtub's thickness of the substantially planar upper apron deck is less than or equal to the thickness of the front wall, and wherein the thickness of the substantially planar upper apron deck is a minimum thickness to which the upper apron deck can be manufactured and maintain structural integrity.

One wall of the first side wall and the second side wall extends vertically at an angle that is greater than 90° between a plane of the base and a plane of the one of the first side wall and the second side wall.

Preferably, the inner corners formed by vertical ends of the first and second side walls of the bathtub, with vertical ends of the front and back walls, are substantially rounded, but having an arc of about one half inch.

Also preferably, the inner corners between lower ends of the first and second side walls and the front and back walls and, an inner surface of the substantially planar base are substantially rounded, but having an arc of about one half inch.

The bathtub's one or more first and second side walls extend inwardly from an outer substantially vertical wall surface of the one or more first and second side walls for a fixed amount, in a substantially parallel relation to the substantially planar base.

Also preferably, when the apron deck is cantilevered, the bathtub's front wall and rear wall each have a thickness of about one inch. When the apron deck is not cantilevered and extends downward in front and rear surface walls to the planar base, the thickness is preferably about two and a half inches, although it can be reduced to about one inch in thickness.

Preferably, the bathtub's front wall and rear wall are tapered, with a top thickness of about one inch and with a bottom thickness of about one and one quarter inch in thickness.

The bathtub also may optionally have hollow interiors, wherein the front wall is hollow, with an outer front wall of about one quarter inch in thickness and an inner front wall of about one quarter inch in thickness, further with a hollow air space therebetween.

The bathtub's rear wall may also optionally have a front rear wall of about one quarter inch in thickness, and a hollow air space of about three quarter inches extending behind the front rear wall up to the surface of the bathroom wall, to accommodate tile and tile grout therebetween.

The cantilevered slanted inward ledge of the apron deck is preferably made of a separate secondary mold, which is attached to the main primary mold for the body of the bathtub. Then the acrylic or other malleable molding material is poured over the two joined molds and the main primary tub mold is inverted, so that the assembled acrylic bathtub will slide downward out of the main primary tub mold. The smaller secondary inward ledge mold is therefore encased within the portion of the tub corresponding to the inwardly extending cantilevered ledge. In the completed acrylic tub, the encased secondary mold piece is slid out laterally from an open end of the tub, within the actual integrally formed cantilevered inward ledge portion of the bathtub. While the bathtub is preferably made with acrylic, it can be made from any malleable material which conforms to complex curves of an analog mold used to form the bathtub.

In the alternate embodiment of this invention, the front of the bathtub is increased in thickness and the cantilevered top apron is not used, so that in that situation, a one piece mold can be used for the assembled bathtub.

In a further alternate embodiment the hollow, substantially rectangular safe egress bathtub has substantially vertical front, rear and side walls being marked with a cover material provided in a first predetermined color. At least one surface of the bathtub is provided in a second predetermined contrasting color contrasting visually to the first predetermined color. In a preferred embodiment, optionally both a top surface of the apron deck and the bottom floor base are provided in a second predetermined contrasting color contrasting visually to the first predetermined color. The first and second contrasting colors provide a vivid color differentiation enabling a bather to visually ascertain a predetermined height of the upper inwardly extending apron deck above the lower floor base of the safe egress bathtub when the bather is mounting into or out of the bathtub.

BRIEF DESCRIPTION OF THE DRAWINGS

The present invention can best be understood in connection with the accompanying drawings. It is noted that the invention is not limited to the precise embodiments shown in the accompanying drawings, in which:

FIG. 1 is a perspective view of a portion of a bathroom enclosing a prior art bathtub;

FIG. 1A is a cross-sectional view of a prior art bathtub with a limited space interior;

FIG. 2 is a perspective detail in partial crossection of a front corner of the prior art tub showing the front deck width;

FIG. 15 is a perspective view of the primary mold piece of a two piece mold used to form that bathtub of the present invention with a cantilevered, inwardly extending apron deck with an undercut;

FIG. 16 is a close up view of a top portion of the front wall of the primary mold piece of FIG. 15, showing a mounting ledge with holes for temporarily attaching a secondary mold piece to the primary mold piece, for making the cantilevered, inwardly extending apron deck of the bathtub, and showing in partial cutaway the long edge of the secondary mold piece, showing the holes;

FIG. 18 is a perspective view of the secondary mold piece for the inward ledge having been installed over the primary mold piece for making the bathtub;

FIG. 19 is a close up perspective detail view of a portion of the secondary mold piece having been installed over the primary mold piece for making the bathtub;

DETAILED DESCRIPTION OF THE INVENTION

Figure 3:
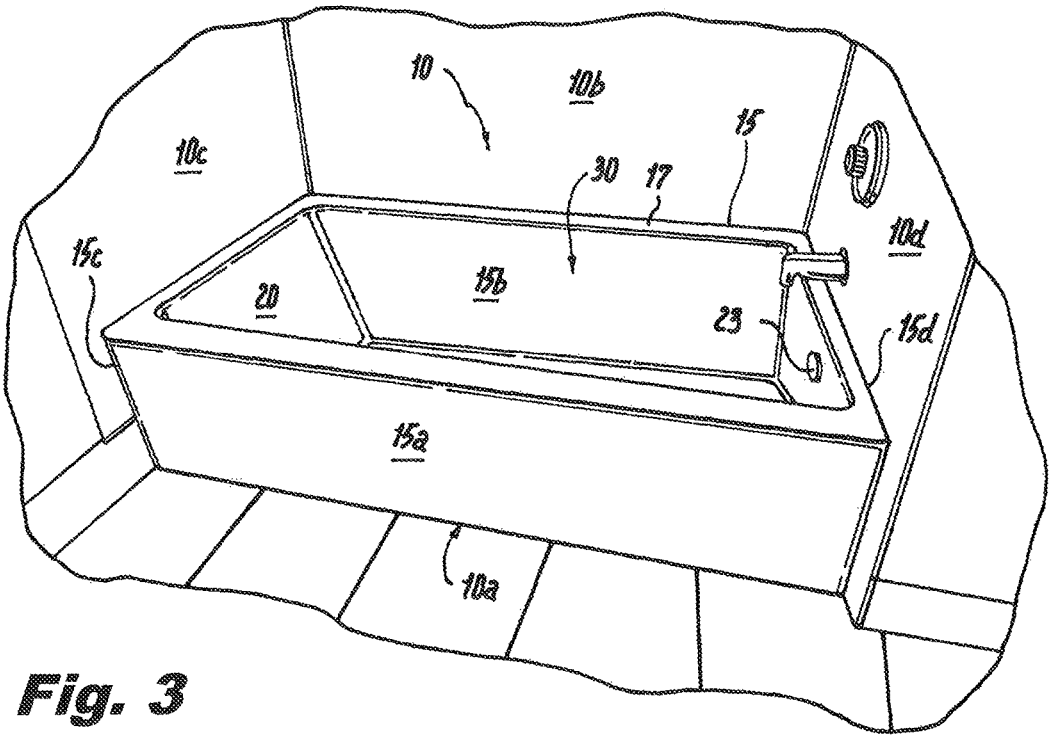
FIG. 3 is perspective view of a portion of a bathroom enclosing the bathtub of this invention.

As shown in Prior Art drawing FIGS. 1 and 2, the prior art tub 2 in bathroom 1 as shown in FIG. 1 is meant to represent any commonly available design. Front deck 3, back deck 4 and side decks 5 are shown. FIG. 2 is a close-up showing the typical wide dimension 8 of front deck 3 as well as the narrower side decks 5 dimension 7.

Figure 4:
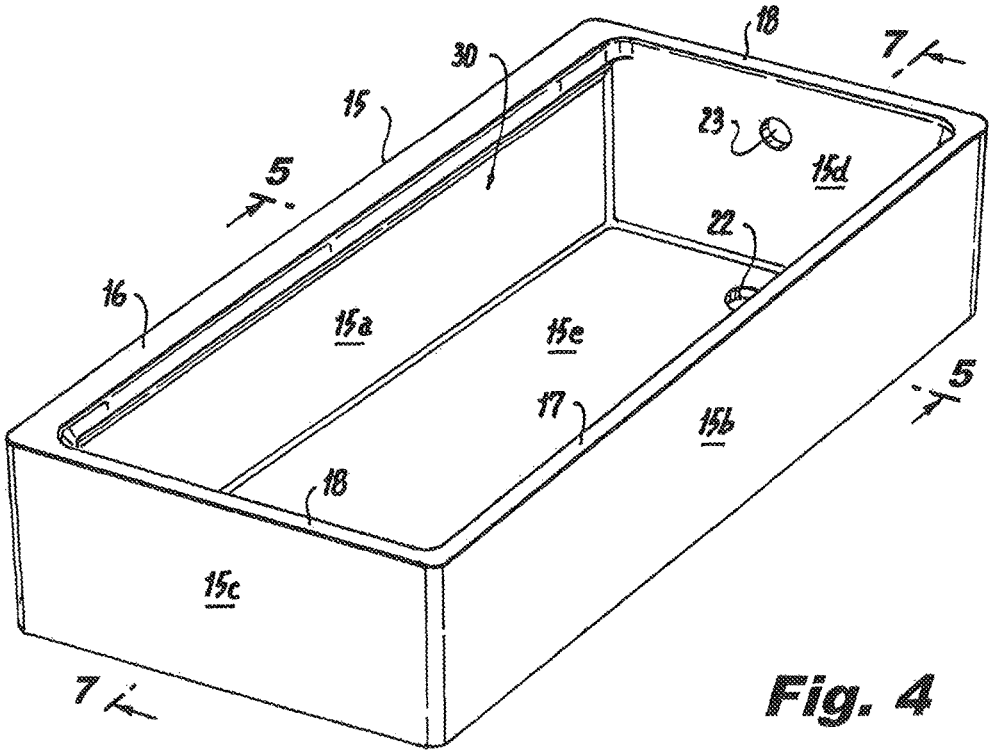
FIG. 4 is a perspective view of the bathtub of this invention.
Figure 5:
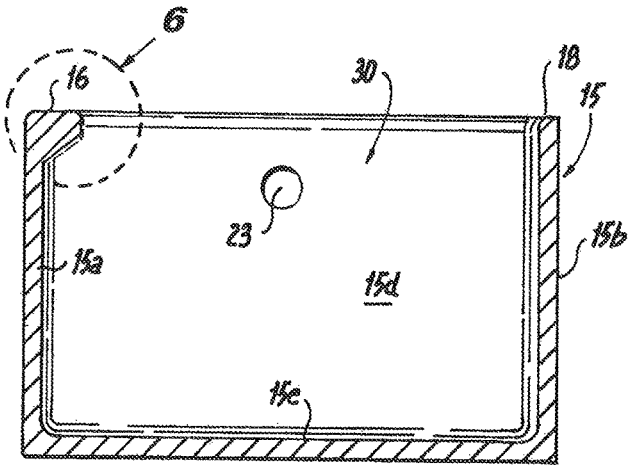
FIG. 5 is an end view crossection showing the profile of the cantilevered front deck.
Figure 6:
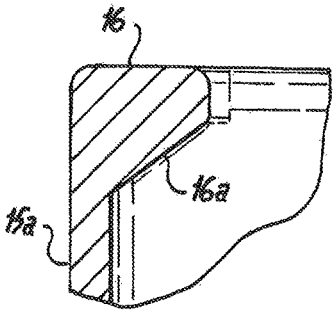
FIG. 6 is an enlarged cross-section detail of the cantilevered front deck.
Figure 5A:
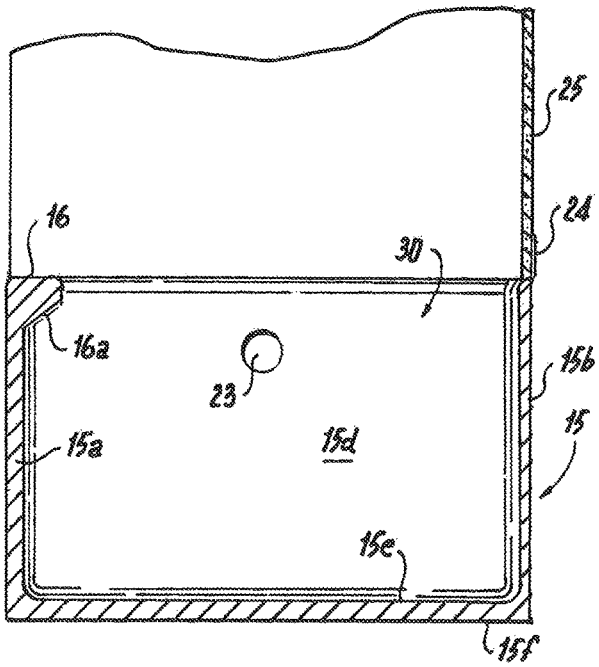
FIG. 5A is an end view crossection of an alternate embodiment, showing the profile of the cantilevered front deck.
Figure 7:
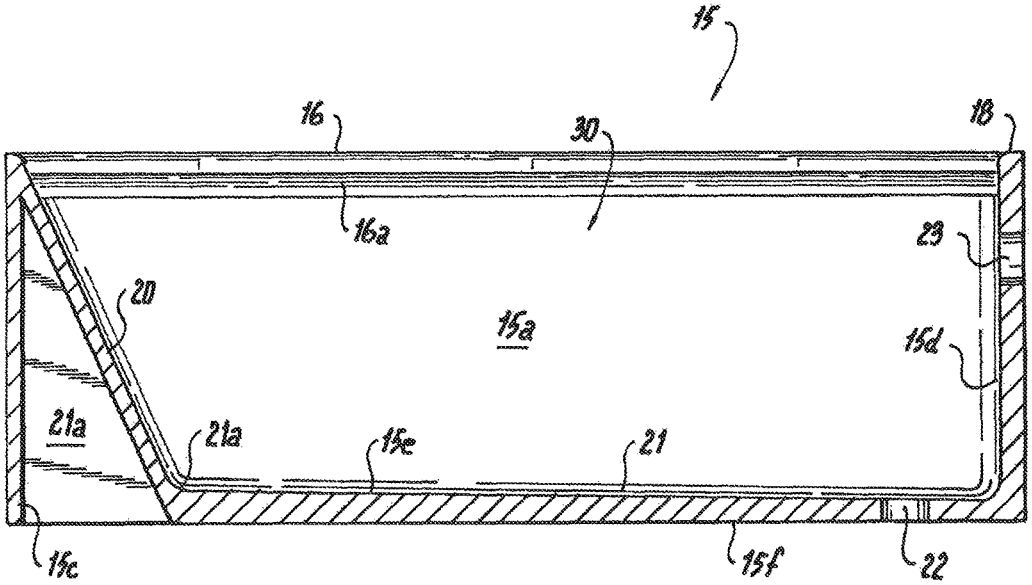
FIG. 7 is a side cross-section view of the bathtub of this invention.

FIGS. 3-9 pertain to one embodiment of the bathtub of this invention. The length of the bathtub can be from four to six feet, the height which could be from fourteen to eighteen inches, and the width which could be from thirty to thirty-six inches. FIG. 3 shows tub 15 in bathroom 10 which is of the same dimensions as bathroom 1 in FIG. 1, which is typically five feet wide (60 inches), thirty inches in front to back depth, and about fourteen inches in height. FIG. 4 shows tub 15 in a perspective view with back deck 17 in the forefront and front deck 16 at the far side. It is noted that side decks 18 as well as back deck 17 have wall widths that are equivalent to the thickness or width of the material comprising the side walls, the back wall and the front wall below the front deck. The crossectional views of FIGS. 5, 5A and 6 show the cantilevered shape of front deck 16 in detail, highlighting that the front deck width does not encumber the interior width of the tub floor. It is further noted that the width dimension 19 is the same as dimension 8 in prior art FIG. 2. FIG. 7 is a length wise crossection showing sloping backrest 20 and slight drain slope 21, which is preferred. In these FIGS. 3-9, large sections are shown as being solid material just for interior dimensional clarity, however they may in fact have enclosed air spaces, such as shown in FIGS. 5C, 9A and 14A herein. This would be especially true of the large wedge shape under back rest 20 and the cantilevered front deck as in FIG. 6; it would depend on the material used and method of construction.

An expanded space bathtub 15 fits in standard tub dimensions of bathroom 10 having footprint floor area 10*a* and vertically extending bathroom wall surfaces 10*b*, 10*c* and 10*d*, and has a larger internal floor area 15*e* of bottom base wall 15*f*, and larger air volume 30 within. The bathtub 15 includes thin walls, including four vertically extending walls, including front wall 15*a* rear wall 15*b*, left side wall 15*c* with sloping backrest 20 adjacent thereto and separated from left side wall 15*c* by hollow interior area 21*a*', and right side wall 15*d* having trip lever hole 23. Vertical walls 15*a*, 15*b*, 15*c* and 15*d* extend vertically upward from rectangular bottom base wall 15*f* having an exterior footprint to fit within the pre-determined rectangular bathtub insertion floor footprint area 10*a* of bathroom 10. Bottom base wall 15*f* has an interior footprint 15*e*, which, with the inside surfaces of vertically extending walls 15*a*, 15*b* 15*c* and sloping backrest wall 20 of left side wall 15*c*, define the enlarged air volume 30 extending therebetween.

The thickness of the vertical walls 15*a*, 15*b*, 15*c*, 15*d* and sloping side backrest 20 is preferably one inch in thickness near the top, up to about one and one quarter inches on the bottom, to provide a slightly sloped surface for easy removal of the tub from a mold. The one inch and one and one quarter inch dimensions need not be solid, so that a front wall 15*o* (shown in FIG. 9A and front wall 56 shown in FIG. 14A) having a thickness of one quarter inch on each front wall portion 15*p* and rear wall portion 15*r* of FIG. 9A, or front wall portion 57 and rear wall portion 59 of FIG. 14A, can have a hollow interior 15*q* of FIG. 9A or hollow interior 58 of FIG. 14A of one half inch. A similar hollow area 15*q* of FIG. 9A, or hollow area 58 of FIG. 14A, can be provided at the slightly wider bottom width of one and one quarter inches total, combined with the walls 15*p* and 15*r* and hollow interior 15*g* of FIG. 9A, or combined with the walls 57 and 59 and hollow interior 58 of FIG. 14A respectively. Moreover, for the rear, wall facing wall 15 of FIG. 5C, the wall portion 15*h* can be just one layer of one quarter inch in thickness, with a three quarter inch hollow area 15*i* behind the one quarter inch wall 15*h*, up to the bathroom wall surface 25 of FIG. 5A or 10*b* of FIG. 5C itself. The one inch thickness at the top 17 of rear wall 15*b* of FIGS. 4 and 5A is required to accommodate tiles of up to ⅝ inch in thickness and accompanying grout against the bathroom wall surface 25. As shown in FIG. 5A, FIG. 9A and FIG. 14A, an optional attachment flange 24 can be attached to rear wall 15*b* of FIG. 5A, rear wall 15*m* of FIG. 9A or rear wall 54 of FIG. 14A, for attachment to bathroom wall surface 25 of FIG. 5A, or bathroom stud wall 10*b* of FIGS. 9A and 14A.

Also preferably, the bathtub 15's front wall 15*a* and rear back wall 15*b* each have an optional thickness of about one inch.

Figure 5B:
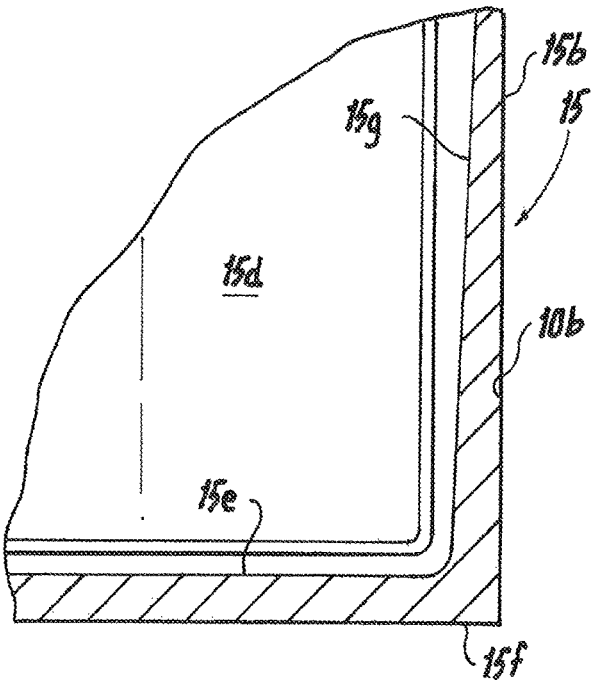
FIG. 5B is a close-up enlarged crossectional detail view of an optional portion of the rear wall of the bathtub, the front wall being an optional mirror view thereof.
Figure 5C:
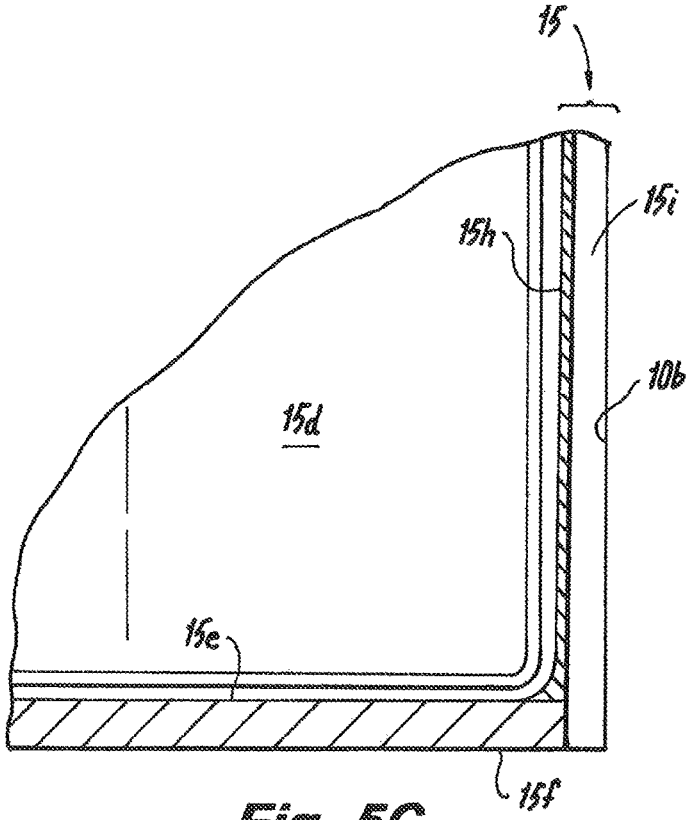
FIG. 5C is a close-up enlarged crossectional detail view of an optional back wall with a thin, front wall position and an air space behind it, the front wall being an optional mirror image thereof.

Optionally, as shown in FIG. 5B, the bathtub's front wall 15*a*, and rear back wall 15*b*, are tapered along tapered surface 15*g*, with a top thickness of about one inch and with a bottom thickness of about one and one quarter inch in thickness.

As shown in FIG. 5C, the bathtub 15's rear wall 15*b* may optionally have a front rear wall portion 15*h* of about one quarter inch in thickness and a hollow air space 15*i* of about three quarter inches extending behind the front rear wall portion 15*h*, up to the surface of the bathroom wall 10*b*, to accommodate tile and tile grout therebetween.

Figure 14:
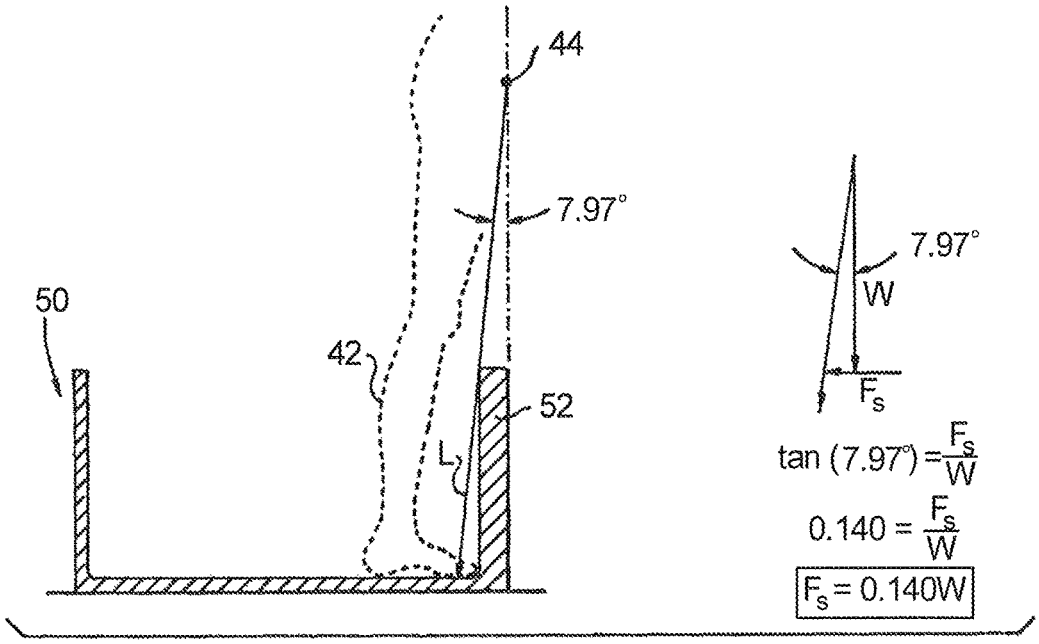
FIG. 14 is an end view profile of the alternate embodiment tub with an outline of the anchor leg of a person in unsupported egress at an instant comparable to that shown in FIGS. 8 and 9, wherein a vector force diagram at the same instant is also shown.
Figure 14A:
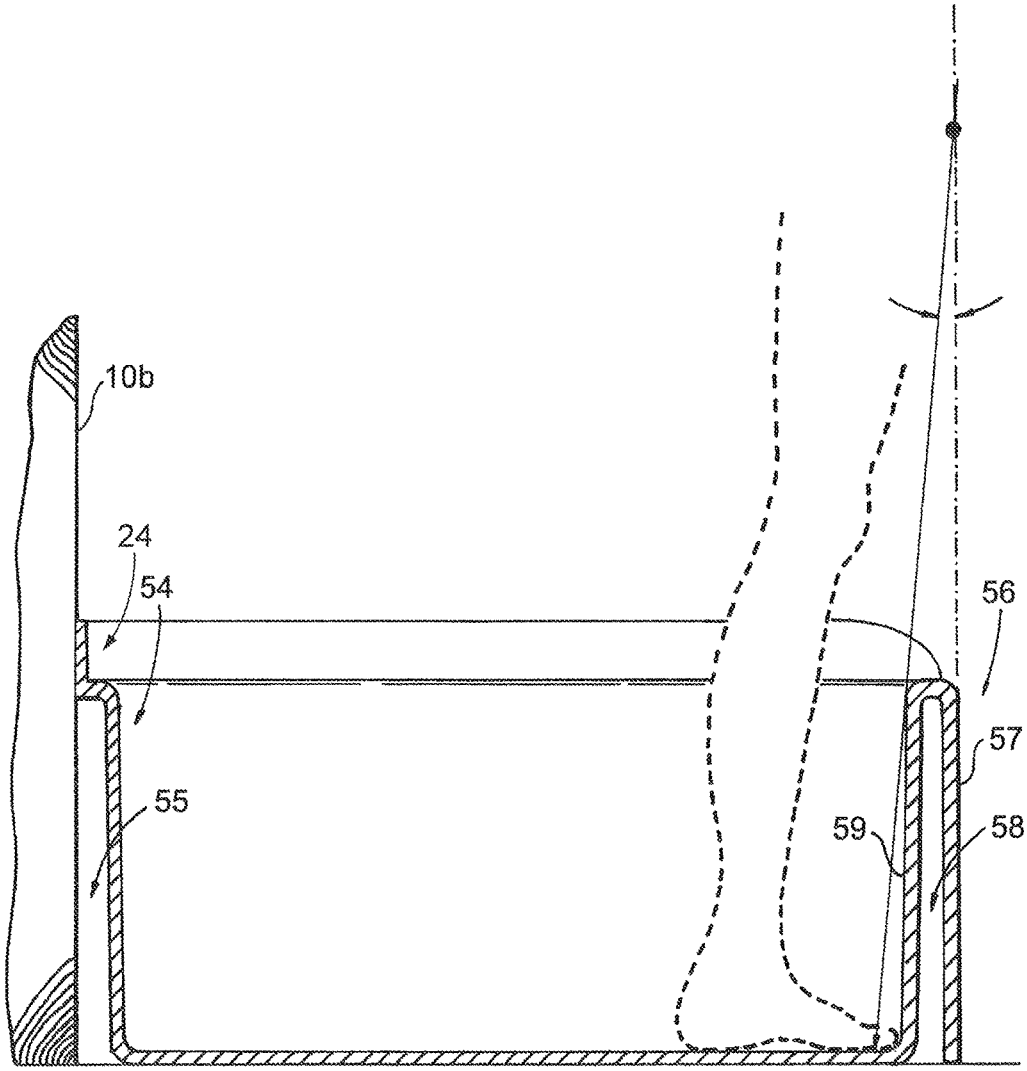
FIG. 14A is an end view profile of a further alternate embodiment tub with an outline of the anchor leg of a person in unsupported egress, wherein the front and rear walls include a hollow space associated therewith.
Figure 14B:
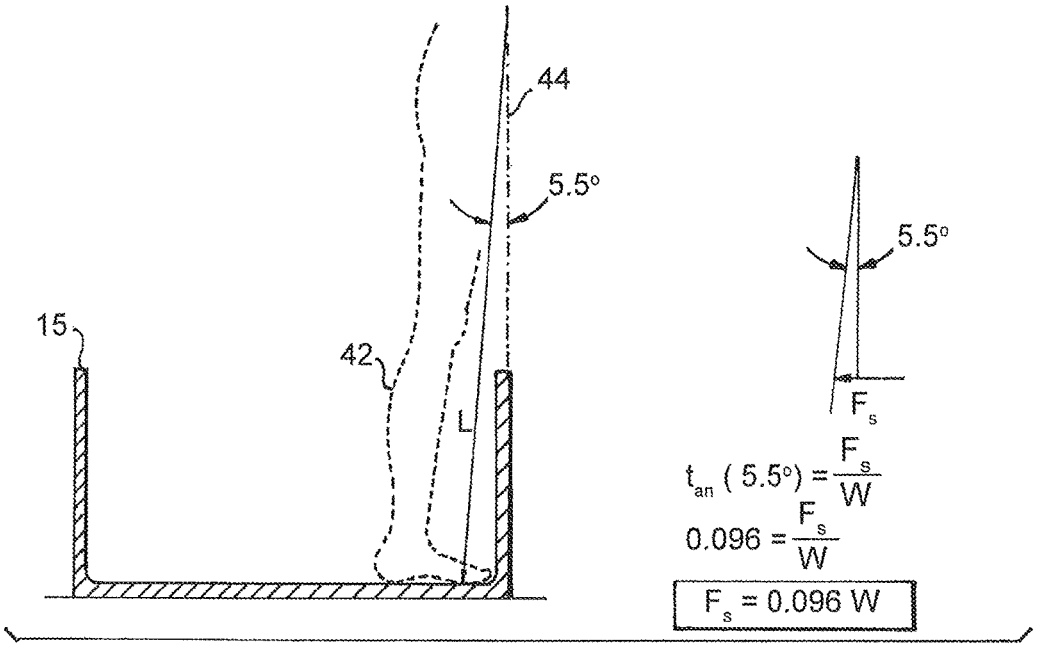
FIG. 14B is an end view profile of a further alternate embodiment tub with a straight vertical front wall with an outline of the anchor leg of a person in unsupported egress, at an instant comparable to that shown in FIGS. 8, 9 and 14, wherein a vector force diagram at the same instant is also shown.

Similar to rear back wall 15*b* shown in FIG. 5A and as also shown in FIGS. 9A and 14A, front wall 15*o* of FIG. 9A or front wall 56 of FIG. 14A (optionally a mirror image of rear back wall 15*b*), as well as front wall 62 of bathtub 60 of FIG. 14B, also may optionally have a hollow interior 15*q* of FIG. 9A or hollow interior 58 of FIG. 14A, wherein the front wall 15*o* of FIG. 9A, 56 of FIG. 14A or 62 of FIG. 14B, is also hollow, with an outer front wall portion 15*p* of FIG. 9A or front wall portion 57 of FIG. 14A of about one quarter inch in thickness and an inner front wall portion 15*r* of FIG. 9A or inner front wall portion 59 of FIG. 14A of about one quarter inch in thickness, further with a hollow air space therebetween, where the inner rear wall portion of rear wall 15*m* of FIG. 9A or rear wall 54 of FIG. 14A is hollow, with rear hollow portions 15*n* of FIG. 9A or 55 of FIG. 14A, where the rear stud wall 10*b* of FIGS. 9A and 14A is positioned similar to positioning of the room wall 10*b* behind air space 15*i* of rear back wall 15*b* in FIG. 5C. The front wall 62 of bathtub 60 of FIG. 14B, can be either solid or hollow, wherein the top of the front to back width of front wall 60 is about one inch in thickness where solid, or totaling about one inch, with an inner front wall portion of about one quarter inch, a hollow portion of about one half inch and a rear wall portion of about one quarter inch.

As shown in the crossectional view of FIG. 7, the inside bottom footprint 15*e* of bottom base wall 15*f* preferably has a slope 21, sloping downward from the corner 21*a* defined by sloping backrest 20 and an adjacent edge of interior footprint 15*e* of bottom base wall 15*f*, downwards towards water drain hole 22.

In the cantilevered apron deck embodiment of FIGS. 3-9, the front apron deck 16's width of up to a maximum of 3.5 inches is maintained within normal construction requirements to support the sliding glass door tracks, but without the need for limiting interior bathtub volume with thick walls. The cantilevered apron deck 16 can also have a reduced width of about two and one half inches. The side decks 18 and back deck 17 are limited to the thickness of the tub material. In the embodiment of FIGS. 3-9, the front apron deck 16 has a width which is maintained to industry standards to support sliding shower wall tracks thereon, but it is cantilevered from the front surface of front wall 15*a* inward and then rejoins the thin inner wall of the front wall 15*a* where its inwardly preferably curved backwards undersurface wall 16*a* meets near the top of the inner surface of front wall 15*a* of bathtub 15, thereby not reducing the interior floor space 15*e* or the interior air volume 30 by the front deck 16's width. The bathtub 15 therefore maximizes internal bathtub/shower stall space within the predetermined confines of typical residential bathroom bathtub and shower space dimensions.

The bathtub 15 of this invention can be made of steel or plastic resin materials and finished as is common in the industry.

A comparison of the interior floor space and enclosed air volume (to the top edge of all four vertical walls the tub) has been made to compare a prior art tub and a tub of FIGS. 3-9 of this invention of the same external dimensions. A prior art front deck of 4" and a back deck of 3" with side decks of 2" in a 60 inch external length by 30 inch tub of 15" average internal depth was assumed for comparison. The wall thickness of the tub of this invention is assumed to be 1". Both tubs have the angled backrest and straight vertical walls. The increased floor area and air volume in the tub of this invention is due to the 1" wall thickness and decks (on 3 edges) vs. the decks of the prior art tub which reduce the internal dimensions.

The results of the comparison are as follows:

Interior Floor Area prior art 1120 sq. in.

this tub 1419 sq. in., a 27% increase.

Interior Air Volume prior art 16790 cubic in.

this tub 20845 cubic in., a 24% increase

Additionally, the above calculations were based upon a prior art bathtub with a front deck of 4" and a back deck of 3" with side decks of 2" in a 60 inch external length by 30 inch tub of 15" average internal depth for comparison. However, since most prior art tubs have sloping and bottom rounded sides, the numbers of this estimate represent the minimum percentage increases in interior floor area and interior volume. It is estimated that in comparison with other prior art bathtubs, with increased sloping and bottom rounded sides, the savings can be up to approximately 35% increase in interior floor area and interior air volume.

Bathtub 15 of this invention also offers safety improvement over that of the prior art. Safety studies indicate over 234,000 bathroom injuries each year, of which 81 percent occurred because of falls in the bathroom. Of these injuries, more than one third happen while bathing or showing. The Center for Disease Controls (CDC) estimates that 9.8 percent of all bathroom injuries specifically occur when getting out of a bathtub, which equals at least 22,932 injuries.

Figure 8:
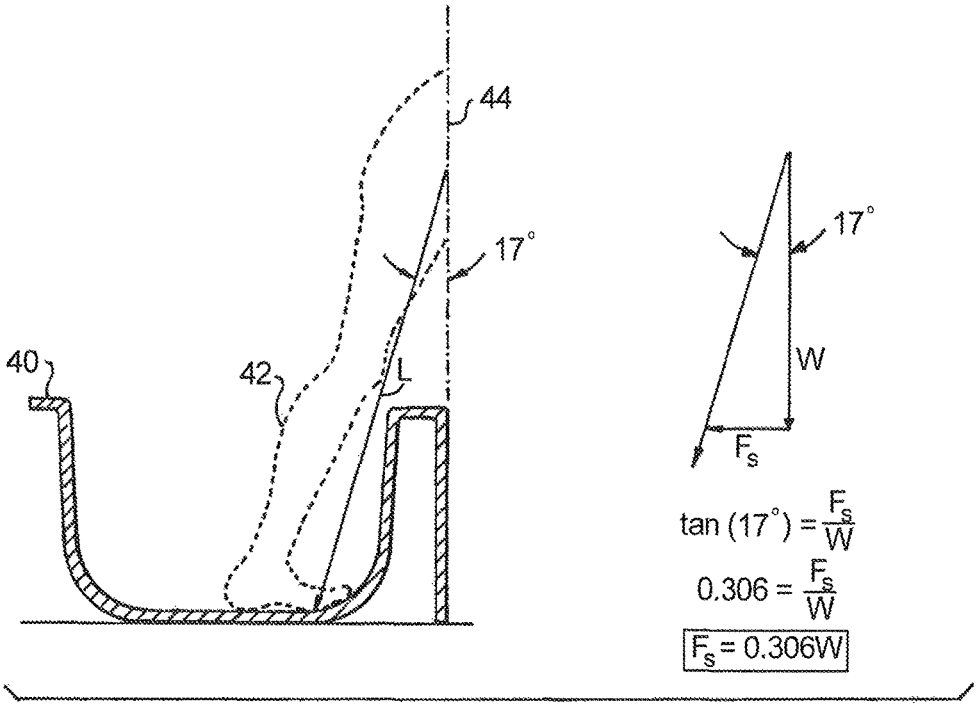
Fig. 8 (Prior Art)
FIG. 8 is an end view profile of a prior art tub with rounded edges at bottom. An outline of the anchor leg of a person in unsupported egress is shown at a particular instant. Also shown is a vector force diagram at the same instant.

FIG. 8 shows a profile of a person 42 exiting a prior art bathtub 40 with rounded walls at the bottom. The "average person" 42 is a composite $50^{th}$ percentile man or woman with a hip joint to floor dimension L of 35 inches. Although the results of the analysis to follow are somewhat dependent on this selected number, let it be said that a taller person would experience slightly less difference in egress from either a prior art tub or the tub 15 of FIGS. 3-9 of this invention, and vice versa for a shorter person. Note that the rounded side bottom edge forces the anchor foot farther away from the front edge of the tub (toward the middle) to be supported by the flat portion; this is also true of prior art profile shown in FIG. 1A with the sloping sides.

The instant for the static analysis of FIG. 8 is that corresponding to the hip joint being directly above the front edge of the tub with the ball of the anchor foot carrying the entire weight of the person before the forward foot (not shown) touches the ground. For the purpose of analysis, the anchor leg can be represented by a rigid rod from the hip joint 44 to the ball of the anchor foot. By measuring the angle in FIG. 8, it is found that this rod makes a 17 degree angle with the vertical as shown in the vector force diagram to the right. The weight of person 42, W, is shown vertically. The horizontal component force Fs that arises from this arrangement is 0.306 W or almost 31% of the weight of the person. This horizontal component must be resisted by the frictional force between the ball of the anchor foot and the tub (or a tub mat). Several items affect the local coefficient of friction between foot and tub, or foot and mat and mat to tub. Water, and especially soapy water, is a good lubricant and dramatically reduces the coefficient of friction. If the anchor foot slips, the bather is in trouble!

Figure 9:
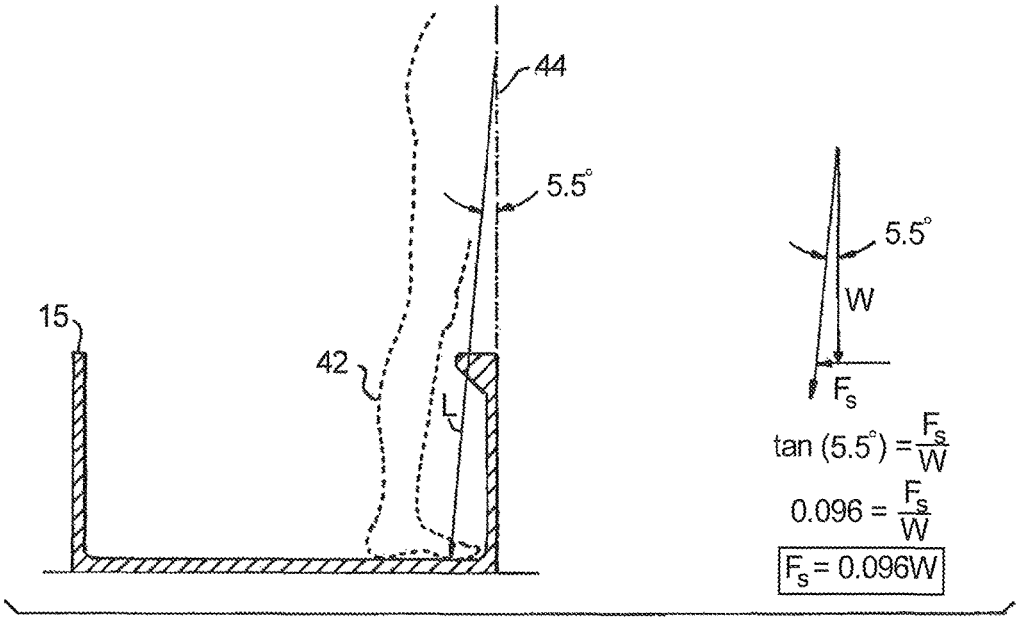
FIG. 9 is an end view profile of the tub of this invention with an outline of the anchor leg of a person in unsupported egress at a comparable instant to that shown in FIG. 8. Also shown is a vector force diagram at the same instant.
Figure 9A:
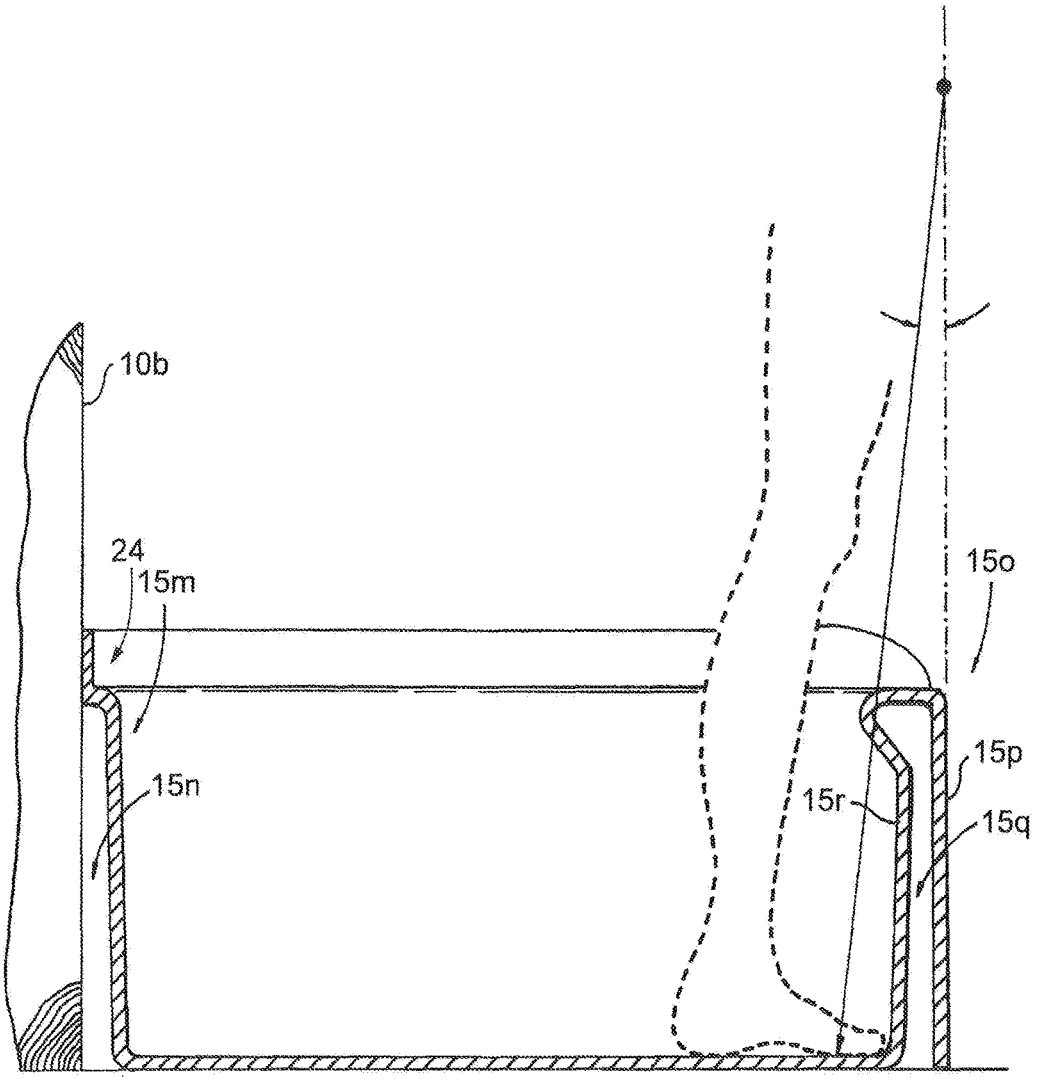
FIG. 9A is an end view profile of a further alternate embodiment tub with an outline of the anchor leg of a person in unsupported egress, wherein the front and rear walls include a hollow space associated therewith.

If a similar analysis of Applicants' expanded space tub 15 is performed as depicted in FIG. 9, the angle of rigid rod and the vertical is only 5.5 degrees because now the anchor foot is so close to the front edge. The horizontal component force Fs that results in this analysis is 0.096 W or only less than 10% of the weight of the person. Thus with the same bather exiting either a prior art tub or a tub 15, slippage can be avoided in a tub 15 of this invention even if the friction coefficient were ⅓ of that which minimally prevented a spill in a conventional tub. Common sense reinforces the numeric example; the tub 15 side walls are substantially vertical; the bather can have the planted leg being substantially vertical and stable, and this requires only lifting the leading leg up and over the thin apron of 3.5 inches or less.

A non-preferred alternate embodiment tub 50 of this invention is the subject of FIGS. 10-14. This tub is similar to tub 15 of this invention, but uses a front panel of thicker material instead of a top cantilever to provide the top resting surface to receive door tracks (if used).

Figure 10:
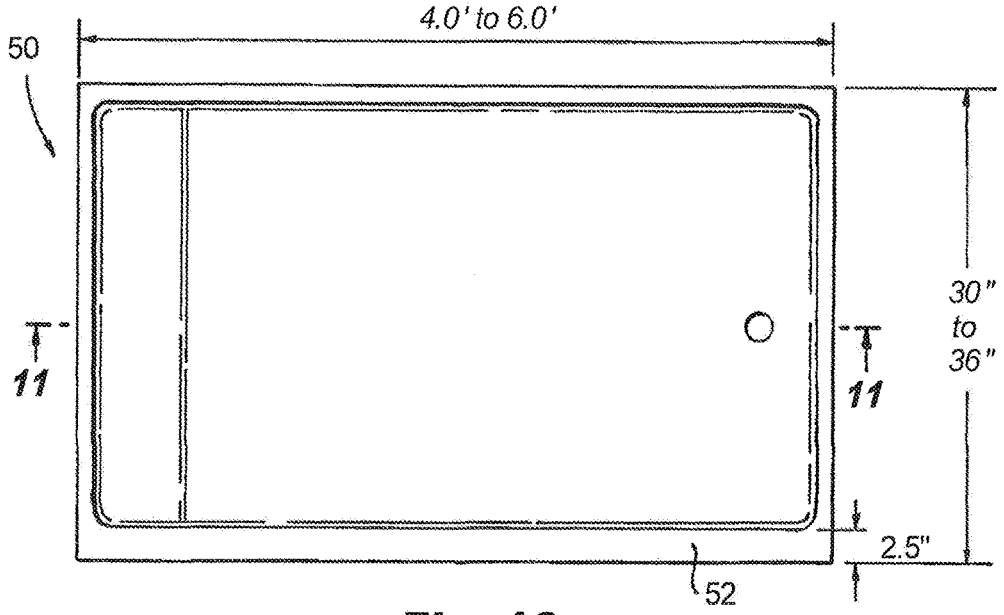
FIG. 10 is a top plan view of an alternate embodiment bathtub of this invention with a thicker front panel (without top cantilever) as shown.
Figure 11:
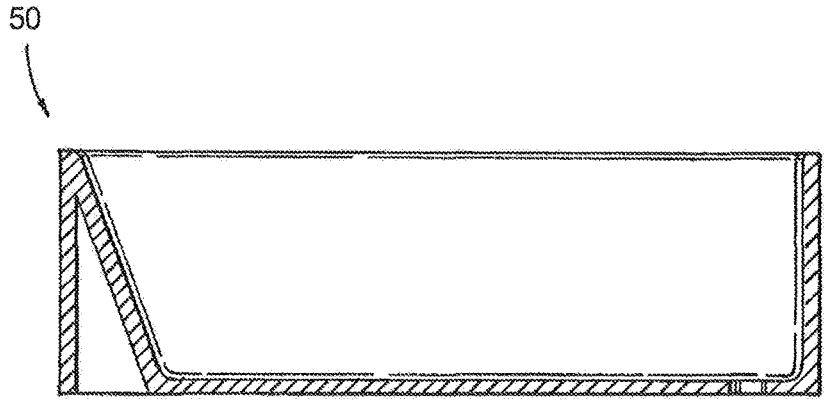
FIG. 11 is a side crossection view of the alternate embodiment of FIG. 10.
Figure 12:
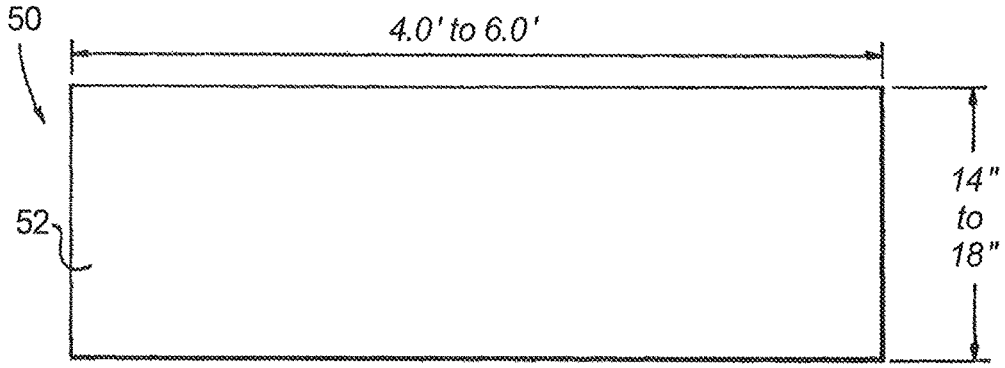
FIG. 12 is a side exterior elevation view of the alternate embodiment.
Figure 13:
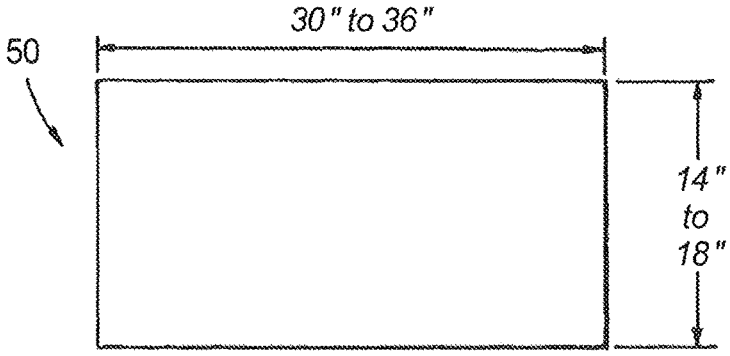
FIG. 13 is an end exterior elevation view of the alternate embodiment.

FIG. 10 is a top view showing a front panel 52 of about 2.5" in thickness. It is noted that the 2.5" thickness can be reduced down from 2.5" in a range of to a top thickness of about one inch, such as shown, for example, in hollow front wall 56 of FIG. 14A or of front wall 62 of bathtub 60 of FIG. 14B. Other dimensions shown in FIGS. 10, 11, 12, and 13 include the length which could be from four to six feet, the height which could be from fourteen to eighteen inches, and the width which could be from thirty to thirty-six inches. The side crossection of FIG. 11 reveals that it is identical in shape to that of FIG. 7 for tub 15.

The side profile of FIG. 14 showing the front panel 52 in crossection more clearly shows the distinction from tub 15 with its cantilever at the top edge (see FIG. 9). FIG. 14 is an egress analysis of person 42 exiting the alternate embodiment tub 50 as was performed before for the prior art, and for tub 15 of this invention. Again, dimension L of a rod from hip joint 44 to the ball of the foot is 35". In this case however, the rod makes an angle of 7.97 degrees with the vertical as opposed to 17 degrees for the prior art situation or 5.5 degrees for tub 15. In tub 50, person 42's foot is forced slightly back (1.5") from the front surface relative to the position in tub 15 due to the thicker front panel 52. This geometry results in a side force (Fs) of 14% of the person's weight, W. While this is not as safe as the case for tub 15, this is still less than half the side force of the prior art tub (31% of the person's weight) analysis of FIG. 8. The side profile of FIG. 14A showing the front panel 56 in crossection more clearly shows the distinction from tub 15. Hollow air 58 space of about one half inch is located within front wall 56 between front wall portion 57 of about one quarter inch in thickness and rear wall portion 59 of front wall 56, also of about one quarter inch in thickness. Rear wall 54 of about one quarter inch includes hollow space 55 of about three quarters of an inch located between rear wall 54 and conventional wall stud 10*b*. To facilitate draining water flow, inner wall portion 59 of front wall 56 and the inner wall portion 54 of FIG. 14A with hollow space 55 between rear wall 54 and conventional wall stud 10*b* can be positioned slightly tapered, so that the bottom of hollow portion 58 of front wall 56 or hollow portion 55 of rear wall 54 can be about three quarters of an inch at the bottom, instead of about one half inch hollow space 58 at the top of front wall 56 or instead of about one half inch hollow space 55 at the top of rear wall 54. FIG. 14B is an egress vector diagram analysis of a person 42 exiting the alternate embodiment tub 60, as was performed for the prior test of FIG. 14 for a bathtub 50 with a straight front wall 52, and for a bathtub 15 with a front wall with a cantilevered undercut portion, as in FIG. 9. Dimension L of a rod from hip joint 44 to the ball of the foot is also 35 inches. In this case show in FIG. 14B, the rod makes an angle of only 5.5 degrees off of the vertical, as also in FIG. 9, because now the anchor foot is also close to the front edge. The horizontal component force F that results in this analysis is 0.096W or only less than 10% of the weight of the person.

Figure 20:
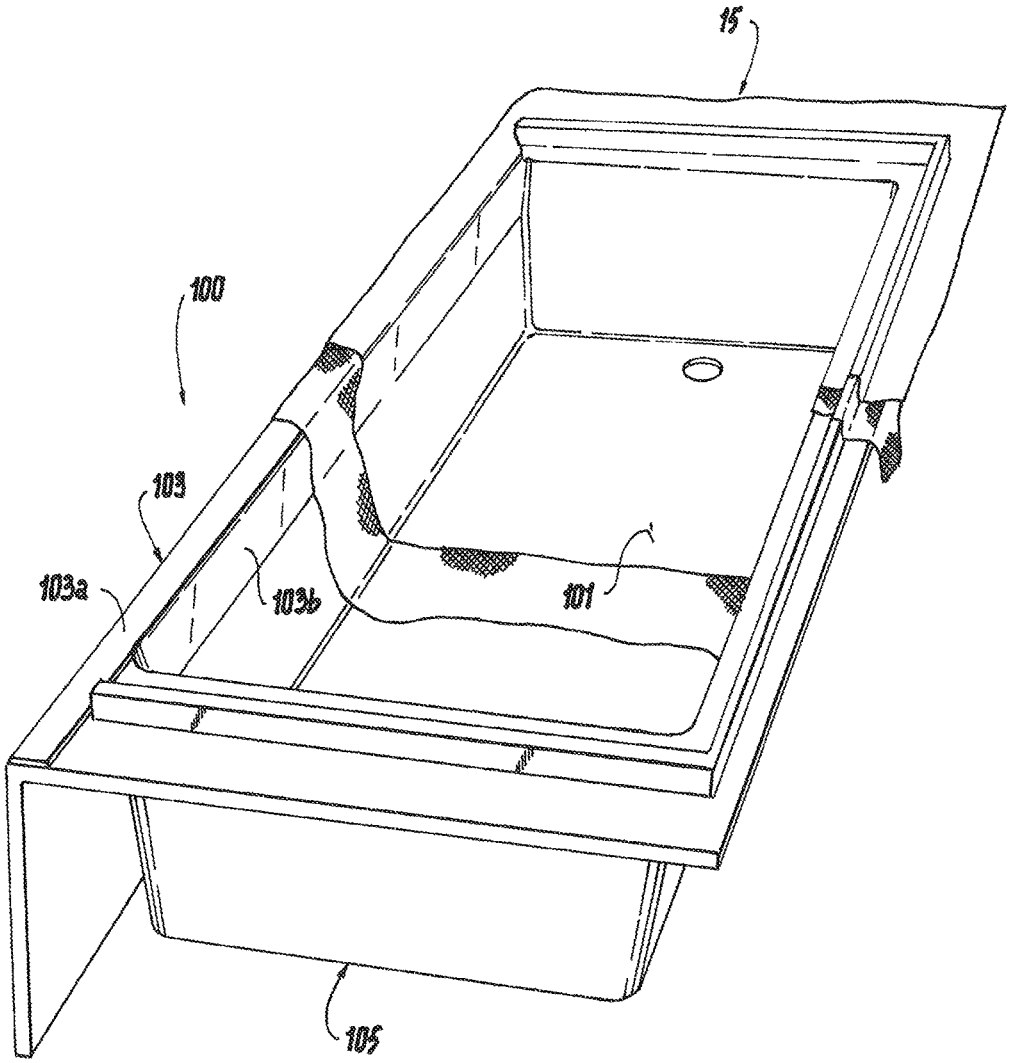
FIG. 20 is a diagrammatic perspective partial crossectional view of a portion of the pourable acrylic material having been poured over a fiberglass sheet laid over a portion of the assembled primary and secondary mold pieces of the two piece mold, used to form the bathtub, with the acrylic material shown sectioned within one portion of one half of the mold, so it can be appreciated how the poured acrylic material conforms to the surfaces of the mold.

FIGS. 15 to 22 show the method of making the bathtub 15 of FIGS. 1-9, with the inwardly extending apron deck ledge 16, by using a two-piece mold 100, so that after the acrylic material 101 is poured into the primary mold piece 102 and set, then the primary mold piece 102 is inverted and the completed bathtub 15 falls easily out of the primary mold piece 102 having hollow tub-shaped portion 105, shown in FIG. 20. The two piece mold is necessary because of the undercut of the inwardly cantilevered apron deck 16.

Figure 17:
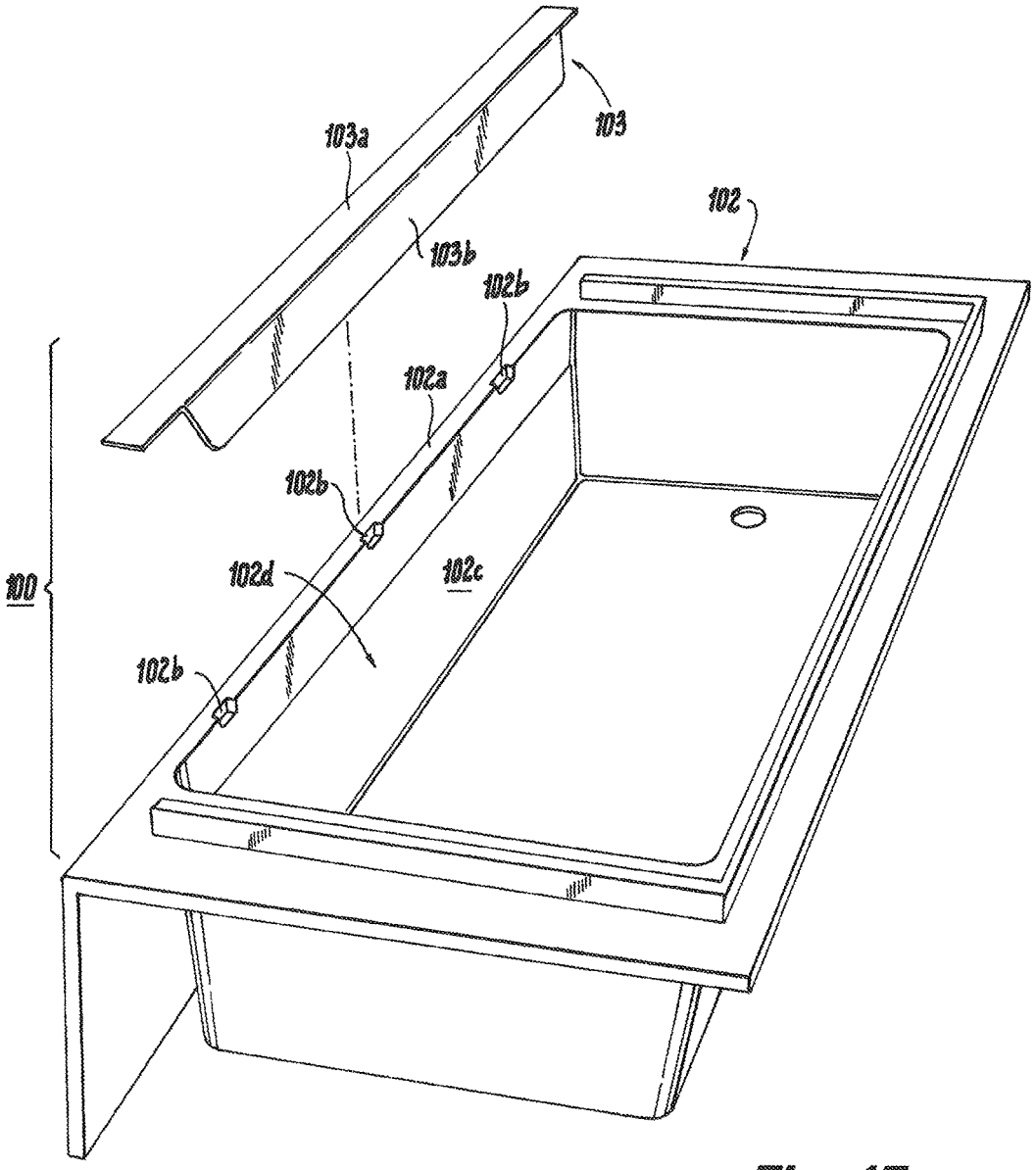
FIG. 17 is an exploded perspective view of the secondary mold piece used to form the cantilevered, inwardly extending apron deck, and wherein the secondary mold piece is shown being installed over the mounting ledge of the primary mold piece for the bathtub.
Figure 21:
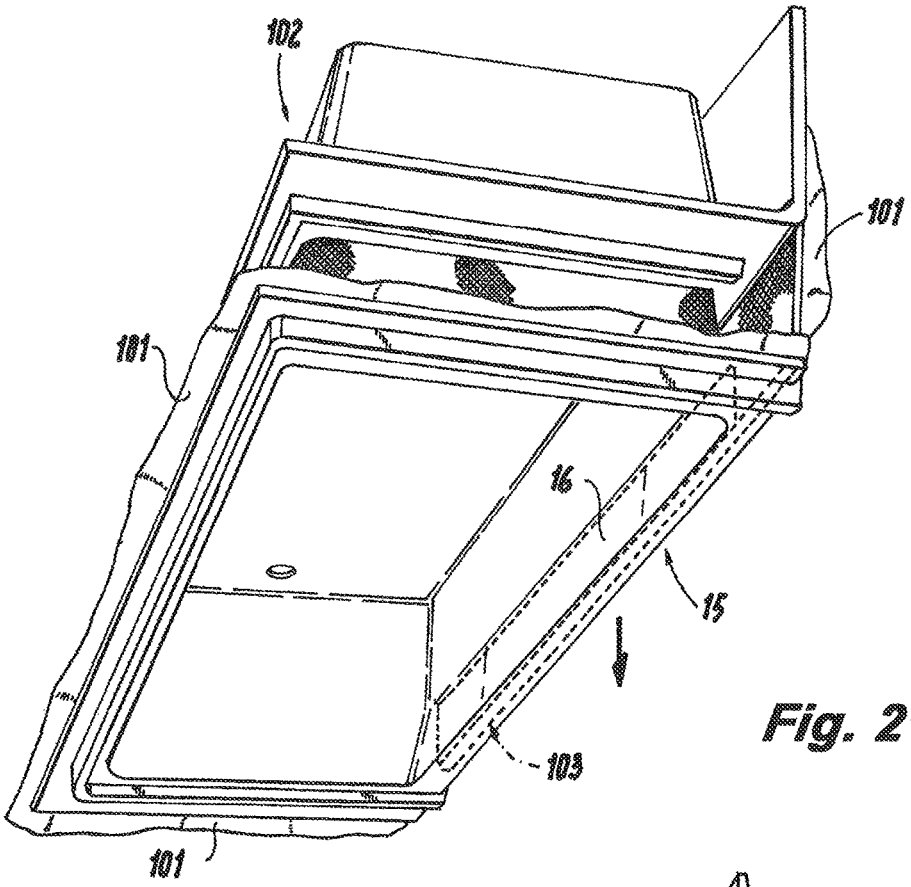
FIG. 21 is an inverted side perspective view of the downward release of the assembled acrylic bathtub with the cantilevered, inwardly extending apron deck, down from the inverted primary mold piece, showing the now formed acrylic bathtub being dropping out partially therefrom, and wherein the secondary mold piece is embedded under the newly formed acrylic cantilevered apron deck.

For example, the cantilevered slanted inward ledge apron deck 16 has to be made of a separate secondary mold piece 103, which is attached to the bathtub 15 as shown in the drawing FIGS. 17-19. Then the acrylic material 101 is poured over a fiberglass layer laid over the two mold pieces 102, 103 as in FIG. 20 and then the main tub mold piece 102 is inverted as in FIG. 21, so that, upon subsequent completion of the mold making of the bathtub 15, the assembled acrylic bathtub 15 will slide downward out of the primary mold piece 102. The smaller secondary inward ledge mold 103 for the inwardly, cantilevered apron deck 16 is then encased within the portion of the tub 15 being the inwardly extending ledge apron deck 16. FIG. 21 also shows excess acrylic material which is trimmed to form the final bathtub 15.

As shown in drawing FIG. 22, of the completed white acrylic tub 15, which is shown inverted after removal as in FIG. 21, the encased secondary mold piece 103 is slid out laterally, in the direction of the arrow shown, from within and below the actual integrally formed inward ledge cantilevered apron deck portion 16 of the bathtub 15.

Figure 22:
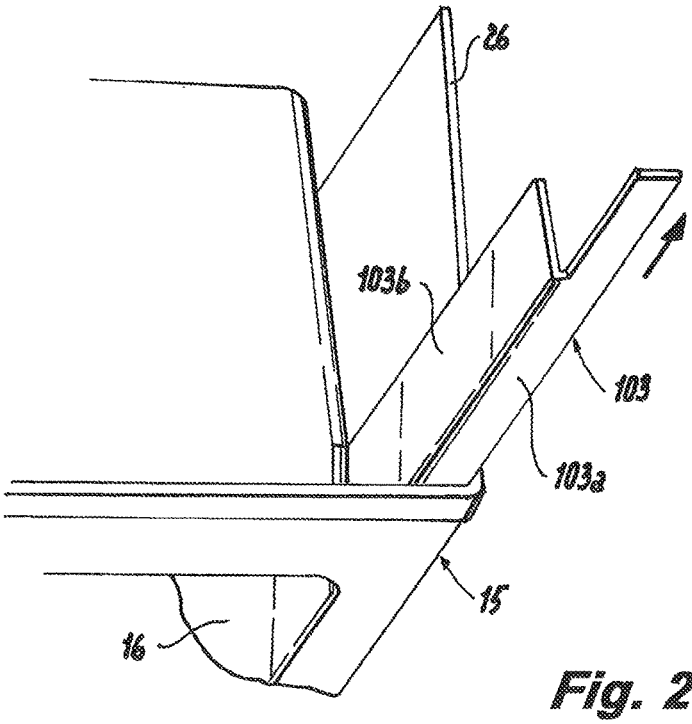
FIG. 22 is an inverted close-up perspective detail view of a portion of the assembled bathtub, having been dropped by gravity from the inverted primary mold piece, with an arrow indicating the lateral sideways pull out directional movement of the removal of the secondary mold piece from beneath the assembled, inwardly cantilevered apron deck portion of the assembled acrylic bathtub.

It is further noted that FIG. 22 shows the upside down inverted bathtub 15, so that the lower right corner of bathtub 15 in FIG. 22 is actually the upper front apron deck 26, when the completed bathtub 15 is turned right side up.

FIGS. 15 and 16 show that the primary mold piece 102 is an analog mirror image of the walls of the bathtub 15, without the cantilevered apron deck 16. A stepped ledge 102*a* with cut-out holes 102*b* is provided for protruding nibs (not shown), to anchor and steady the secondary mold piece 103 in place therein, for positioning of the molding of the cantilevered apron deck 16 with an undercut.

FIGS. 17-19 show the angled secondary mold piece 103 with substantially horizontal top ledge 103*a* and angled undercut slanted surface 103*b*, which has a bottom edge, which meets the inside 102*c* of the front wall 102*d* of the primary mold piece 102.

FIG. 20 shows the acrylic mold material 101 being poured over the flexible fiberglass sheet covering the assembled two piece mold 102, 103.

FIG. 21 shows the inverted bathtub 15 being dropped out of the primary mold piece 102, while the secondary mold piece 103 (shown in phantom) is captured under the cantilevered apron deck 16, and laterally or otherwise removed as in FIG. 22 in the direction of the arrow.

Figure 23:
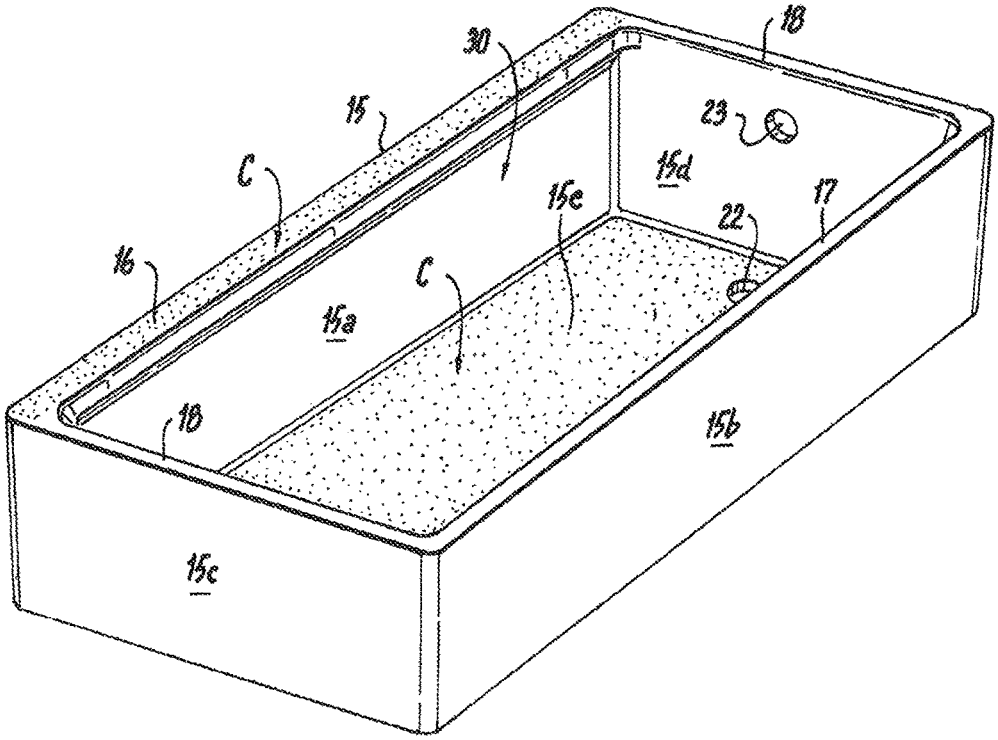
FIG. 23 is a perspective view of an alternate embodiment of the bathtub of this invention; where contrasting colors are provided on two or more selected surfaces of the bathtub, to enhance depth perception of a bather entering or exiting a bathtub with at least a wet floor, or a volume of water therein; and, FIG. 24 is a perspective view of an alternate embodiment of the bathtub of this invention; where contrasting colors are provided on at least one selected surface of the bathtub, to enhance depth perception of a bather entering or exiting a bathtub with at least a wet floor, or a volume of water therein.

FIG. 23 shows an alternate embodiment with contrasting color markings on the expanded space bathtub 15, to conform to falls prevention recommendations of the American Occupational Therapy Association (AOTA), whereby AOTA recommendations provide that stair treads and other household items have contrasting colors, to enhance the depth perception of persons with or without impaired vision who are walking in a home environment. The bathtub 15 in FIG. 23 includes thin walls, including four vertically extending walls, including front wall 15*a*, rear wall 15*b*, left and right side walls 15*c*, 15*d* separated by a hollow interior volume area 30. The right side wall 15*d* has trip lever hole 23 and the bottom base floor footprint area 15*e* has drain hole 22. Vertical walls 15*a*, 15*b*, 15*c* and 15*d* extend vertically upward from bottom base wall footprint area 15*e*. Front wall 15*a* has cantilevered inwardly extending apron deck ledge 16.

In order to attempt to comply with the AOTA recommendations for increasing depth perception on stair treads, the bathtub 15 of the embodiment shown in FIG. 23 of the present invention, includes contrasting colored areas "C" represented by the stippling shown in the areas designated as "C". For example, at least one surface of the bathtub is provided in a second predetermined contrasting color contrasting visually to the first predetermined color. In a preferred embodiment, optionally such as shown in FIG. 23, the contrasting color C is provided on the apron deck 16 and then lower floor area 15*e*. Because the apron deck 16 is higher than the bathtub floor area 15*e*, the colored areas "C": are separated by the otherwise contrasting lighter color of the vertically extending walls 15*a*, 15*b*, 15*c* and 15*d* of bathtub 15. Therefore, while any contrasting colors can be used, in one example, a dark Royal Blue color on the top apron deck 16 will contrast with the lighter walls 15*a*, 15*b*, 15*c* and 15*d* of bathtub 15, above the darker Royal blue color of the floor 15*e*. By providing the darker contrasting colors "C" at the top of the tub to be stepped over by a bather, with the lower floor base 15*e* of the same contrasting color differentiated by the lighter color of the vertically extending walls 15*a*, 15*b*, 15*c* and 15*d*, the bather will be able to better estimate the distance of the lighter colored vertical walls above the Royal Blue colored floor 15*e* and below the Royal Blue colored apron deck 16.

The stippling of FIG. 23 represents any contrasting color which contrasts with the generally lighter vertically extending walls 15*a*, 15*b*, 15*c* and 15*d* (such as, for example, white, pink, light green or beige colors). If perchance the tub is made of a material of a darker color, such as, for example, Hunter Green, or Black, then the top apron deck 16 and lower floor 15*e* of bathtub 15 would be colored in a light, contrasting color, instead of a dark, contrasting color.

While FIG. 23 shows the darker contrasting colors on the apron deck 16 and the floor 15*e*, optionally one or more of the other top surfaces 17 or 18 of the rear wall 15*b* onside walls 15*c* and 15*d* can also be portrayed in the dark or light contrasting color of the apron deck 16 and floor 15*e*.

Figure 24:
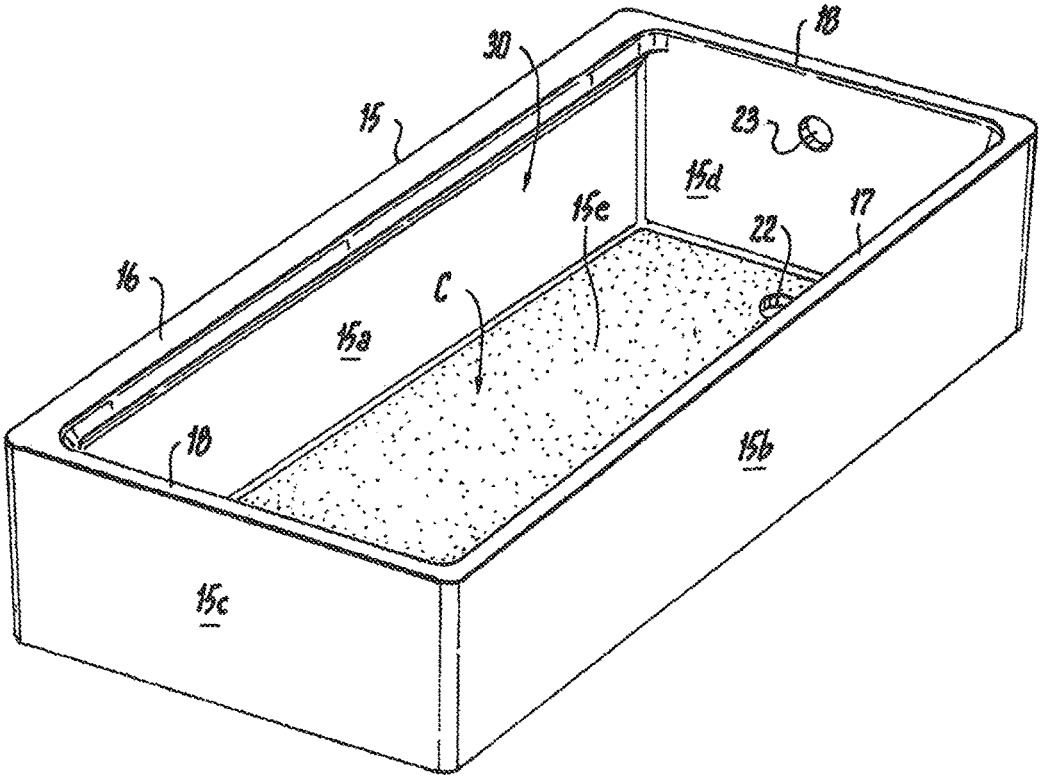

FIG. 24 shows an alternate embodiment of the bathtub of this invention; where a contrasting color is provided on at least one selected surface 15*e* of the bathtub, to enhance depth perception of a bather entering or exiting a bathtub with at least a wet floor, or a volume of water therein. While the contrasting color C is shown on the floor 15*e*, it could optionally be instead on another surface, such as, for example, apron deck 16, or other surface of the bathtub.

It is further noted that the slanted undersurface of the inwardly extending cantilevered apron deck can assume various configurations. For example, the sloping undercut surface of the apron deck can have variable angles, such as, for example, the undersurface 16*a* descending from a shoulder, at a wide angle. Alternatively, the slanted undersurface can be longer and have less of an inwardly extending angle, such as would be formed by acrylic poured over undercut slanted surface 103*b* of a secondary mold piece, shown in FIGS. 17-19. Moreover, the slanted undercut surface can be straight, curved or combinations thereof.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A safe egress bathtub consisting essentially of:

substantially vertical back and front walls, first and second end walls and a flat bottom wall, wherein said walls comprise rigid material and are configured for entry and egress over said front wall and for said back wall to abut or be embedded in a room wall;

said bottom wall extending to a flat, substantially vertical inner surface of said front wall;

said front wall extending between said end walls and consisting essentially of a flat, vertical inner surface and a flat, vertical outer surface, and a deck comprising a flat horizontal top surface extending inwardly from a top edge of said outer surface, said flat horizontal top surface of said front wall of said bathtub further consisting essentially of a cantilevered portion extending only inwardly, said only inwardly extending cantilevered portion having a flat, straight top outer surface and a distal free end with a downwardly extending outer surface extending from a distal end of said cantilevered portion, and a straight horizontal directed lower undersurface portion extending horizontally and inwardly to and rejoining said inner surface of said front wall, said cantilevered portion not extending beyond said vertical outer surface of said front wall; and said flat horizontal top surface having a thickness or width in a range from 1 to 2½ inches extending a full length of said front wall to obtain a straddle angle of egress over said front wall to minimize a horizontal component of force for reducing an incidence of slippage and falling when said bottom wall is wet during entry and egress of a user.

2. The safe egress bathtub of claim 1, wherein said range is configured to support sliding shower wall tracks thereon.

3. The safe egress bathtub as in claim 1:

further comprising respective inner corners formed by vertical ends of the first and second end walls of the bathtub, with vertical ends of the front and back walls, are substantially concavely rounded, and having an arc radius of about one half inch; and, respective inner corners formed between lower ends of the first and second end walls and the front and back walls are substantially rounded and joined to an inner surface of the substantially planar base also being substantially concavely rounded, and having an arc radius of about one half inch.

4. The safe egress bathtub of claim 1, wherein said straddle angle of egress over said front wall is about 5.5 degrees.

5. The safe egress bathtub of claim 1, wherein a top surface of said vertical back wall has a thickness of about one inch.

* * * * *